US009491828B2

(12) United States Patent
Negley et al.

(10) Patent No.: US 9,491,828 B2
(45) Date of Patent: Nov. 8, 2016

(54) SOLID STATE LIGHTING DEVICES AND METHODS OF MANUFACTURING THE SAME

(71) Applicant: CREE, INC., Durham, NC (US)

(72) Inventors: Gerald H. Negley, Durham, NC (US); Antony Paul Van De Ven, Hong Kong SAR (CN); Kenneth R. Byrd, Cedar Grove, NC (US); Peter J. Myers, Dunedin, FL (US); Michael Harris, Cary, NC (US)

(73) Assignee: Cree, Inc., Durham, NC (US)

( * ) Notice: Subject to any disclaimer, the term of this patent is extended or adjusted under 35 U.S.C. 154(b) by 33 days.

(21) Appl. No.: 14/474,824

(22) Filed: Sep. 2, 2014

(65) Prior Publication Data

US 2014/0368117 A1 Dec. 18, 2014

Related U.S. Application Data

(62) Division of application No. 12/257,804, filed on Oct. 24, 2008, now Pat. No. 8,866,410.

(60) Provisional application No. 60/990,724, filed on Nov. 28, 2007, provisional application No. 61/041,404, filed on Apr. 1, 2008.

(51) Int. Cl.
*H05B 37/02* (2006.01)
*H05B 33/08* (2006.01)

(52) U.S. Cl.
CPC ..... *H05B 33/0869* (2013.01); *H05B 33/086* (2013.01); *H05B 33/0809* (2013.01)

(58) Field of Classification Search
CPC ... H01L 2924/00; H01L 33/60; H01L 33/50; H01L 33/62; F21Y 2101/02; F21Y 2105/001; F21Y 2113/005; F21Y 2103/003; F21K 9/56; H05B 33/0803; H05B 37/02; H05B 33/0857; H05B 33/0815; H05B 33/0842; H05B 33/0869; H05B 39/02; G05F 1/10; G05F 3/02
USPC ..... 315/185 S, 200 A, 322–324, 291, 312, 315/307, 149–152, 185 R, 294, 302; 362/84, 362/231, 260, 545, 612, 800
See application file for complete search history.

(56) References Cited

U.S. PATENT DOCUMENTS 3,927,290 A 12/1975 Denley
4,329,625 A 5/1982 Nishizawa et al.

(Continued)

FOREIGN PATENT DOCUMENTS

CA 2171244 9/1996
CN 1460393 12/2003

(Continued)

OTHER PUBLICATIONS

U.S. Appl. No. 11/613,692, filed Dec. 20, 2006.

(Continued)

*Primary Examiner* — Jason M Crawford
(74) *Attorney, Agent, or Firm* — Burr & Brown, PLLC

(57) ABSTRACT

Lighting devices comprising first, second and third strings of solid state lighting devices. One aspect further comprises means for supplying first fixed current through the first string, means for supplying second fixed current through the second string, and means for supplying current through the third string. In a second aspect, the first and second strings emit light within a specific area on a 1931 CIE Chromaticity Diagram, and the third string emits light of dominant wavelength 600-640 nm. A third aspect further comprises a power line and a power supply configured to supply a first and second fixed currents through the first and second strings, respectively, and supply a current to the third string. A method of making a lighting device, comprising measuring color output, adjusting current to first, second and/or third strings, and permanently setting currents to the first and second strings.

20 Claims, 4 Drawing Sheets

(56) References Cited

U.S. PATENT DOCUMENTS 5,264,997 A 11/1993 Hutchisson et al.
5,767,837 A 6/1998 Hara
5,783,909 A 7/1998 Hochstein
5,803,579 A 9/1998 Turnbull et al.
5,851,063 A 12/1998 Doughty et al.
5,926,238 A 7/1999 Inoue
5,959,316 A 9/1999 Lowery
6,069,676 A 5/2000 Yuyama
6,078,148 A 6/2000 Hochstein
6,095,666 A 8/2000 Salam
6,127,784 A 10/2000 Grossman et al.
6,132,072 A 10/2000 Turnbull et al.
6,153,985 A 11/2000 Grossman
6,212,213 B1 4/2001 Weber
6,234,648 B1 5/2001 Borner et al.
6,236,331 B1 5/2001 Dussureault
6,285,139 B1 9/2001 Ghanem
6,292,901 B1 9/2001 Lys et al.
6,335,538 B1 1/2002 Prutchi et al.
6,350,041 B1 2/2002 Tarsa et al.
6,357,889 B1 3/2002 Duggal et al.
6,362,578 B1 3/2002 Swanson et al.
6,411,046 B1 6/2002 Muthu
6,441,558 B1 8/2002 Muthu et al.
6,495,964 B1 12/2002 Muthu et al.
6,498,440 B2 12/2002 Stam et al.
6,507,159 B2 1/2003 Muthu
6,510,995 B2 1/2003 Muthu et al.
6,513,949 B1 2/2003 Marshall et al.
6,538,371 B1 3/2003 Duggal et al.
6,550,949 B1 4/2003 Bauer et al.
6,552,495 B1 4/2003 Chang
6,576,881 B2 6/2003 Muthu et al.
6,576,930 B2 6/2003 Reeh et al.
6,577,073 B2 6/2003 Shimizu et al.
6,608,614 B1 8/2003 Johnson
6,611,000 B2 8/2003 Tamura et al.
6,624,350 B2 9/2003 Nixon et al.
6,630,801 B2 * 10/2003 Schuurmans ..... H05B 33/0869 315/307
6,633,301 B1 10/2003 Dallas et al.
6,636,003 B2 10/2003 Rahm et al.
6,674,060 B2 1/2004 Antila
6,692,136 B2 2/2004 Marshall et al.
6,740,972 B2 5/2004 Smith et al.
6,741,351 B2 5/2004 Marshall et al.
6,784,463 B2 8/2004 Camras et al.
6,809,347 B2 10/2004 Tasch et al.
6,817,735 B2 11/2004 Shimizu et al.
6,836,081 B2 12/2004 Swanson et al.
6,841,804 B1 1/2005 Chen et al.
6,841,947 B2 1/2005 Berg-johansen
6,914,267 B2 7/2005 Fukasawa et al.
6,936,857 B2 8/2005 Doxsee et al.
7,005,679 B2 2/2006 Tarsa et al.
7,008,078 B2 3/2006 Shimizu et al.
7,009,343 B2 3/2006 Lim et al.
7,014,336 B1 3/2006 Ducharme et al.
7,023,543 B2 4/2006 Cunningham
7,066,623 B2 6/2006 Lee et al.
7,093,958 B2 8/2006 Coushaine
7,095,056 B2 8/2006 Vitta et al.
7,135,664 B2 * 11/2006 Vornsand et al. ..... 250/205
7,140,752 B2 11/2006 Ashdown
7,173,384 B2 2/2007 Plotz et al.
7,186,000 B2 3/2007 Lebens et al.
7,202,608 B2 4/2007 Robinson et al.
7,208,713 B2 * 4/2007 Ishiguchi ..... H05B 33/0872 250/205
7,213,940 B1 * 5/2007 Van De Ven et al. ..... 362/231
7,221,044 B2 5/2007 Fan et al.
7,256,557 B2 8/2007 Lim et al.
7,281,816 B2 10/2007 Suzuki
7,312,927 B2 12/2007 Bogner et al.
7,354,172 B2 * 4/2008 Chemel et al. ..... 362/231
7,358,954 B2 4/2008 Negley et al.
8,058,816 B2 * 11/2011 Sejkora ..... H05B 33/0863 315/152
2001/0035853 A1 11/2001 Hoelen et al.
2002/0070681 A1 6/2002 Shimizu et al.
2002/0070914 A1 6/2002 Bruning et al.
2002/0171373 A1 * 11/2002 Muthu ..... 315/219
2002/0190972 A1 12/2002 Ven de Van
2003/0030063 A1 2/2003 Sosniak et al.
2003/0052594 A1 3/2003 Matsui et al.
2003/0072153 A1 4/2003 Matsui et al.
2003/0089918 A1 5/2003 Hiller et al.
2003/0117798 A1 6/2003 Leysath
2003/0146411 A1 8/2003 Srivastava et al.
2003/0230991 A1 12/2003 Muthu et al.
2004/0021859 A1 2/2004 Cunningham
2004/0062040 A1 4/2004 Blume et al.
2004/0070333 A1 4/2004 Lin et al.
2004/0105261 A1 6/2004 Ducharme et al.
2004/0208210 A1 10/2004 Inoguchi
2004/0212998 A1 10/2004 Mohacsi
2004/0217364 A1 11/2004 Tarsa et al.
2004/0218388 A1 11/2004 Suzuki
2004/0262623 A1 12/2004 You
2004/0264193 A1 12/2004 Okumura
2005/0024834 A1 2/2005 Newby
2005/0052378 A1 3/2005 Hacker
2005/0062446 A1 3/2005 Ashdown
2005/0082974 A1 4/2005 Fukasawa et al.
2005/0099478 A1 5/2005 Iwase
2005/0117334 A1 6/2005 Lee et al.
2005/0134202 A1 * 6/2005 Lim ..... H05B 33/086 315/312
2005/0259439 A1 11/2005 Cull et al.
2005/0274972 A1 12/2005 Roth et al.
2006/0007553 A1 1/2006 Bogner et al.
2006/0012989 A1 1/2006 Lee et al.
2006/0022616 A1 2/2006 Furukawa et al.
2006/0049781 A1 3/2006 Lee et al.
2006/0104058 A1 5/2006 Chemel et al.
2006/0105482 A1 5/2006 Alferink et al.
2006/0163589 A1 7/2006 Fan et al.
2006/0214174 A1 9/2006 Shirakuma et al.
2006/0221644 A1 10/2006 Kwon et al.
2006/0256049 A1 11/2006 Schou
2007/0040512 A1 2/2007 Jungwirth et al.
2007/0081357 A1 4/2007 Kim et al.
2007/0115228 A1 5/2007 Roberts et al.
2007/0223219 A1 9/2007 Medendorp et al.
2007/0247414 A1 10/2007 Roberts
2008/0103714 A1 * 5/2008 Aldrich ..... G01J 3/46 702/81
2009/0296384 A1 * 12/2009 Van De Ven et al. ..... 362/231

FOREIGN PATENT DOCUMENTS

CN 2775469 4/2006
CN 1828921 9/2006
DE 196 08 898 10/1999
DE 10-335077 3/2005
DE 10 2004 023 186 12/2005
DE 20 2005 020 801 9/2006
EP 1 081 771 3/2001
EP 1 152 642 4/2001
EP 1 111 966 6/2001
EP 1 160 883 12/2001
EP 1 548 573 12/2003
EP 1 462 711 9/2004
EP 1 589 519 4/2005
EP 1 564 821 8/2005
EP 1 583 147 10/2005
EP 1 622 427 2/2006
EP 1 628 286 2/2006
EP 2 051 565 A2 4/2009
FR 2 426 381 12/1979
FR 2 854 252 4/2003
JP 09-199756 7/1997
JP 10-012926 1/1998
JP 10-163535 6/1998

(56) References Cited

FOREIGN PATENT DOCUMENTS

| | | |
|---|---|---|
| JP | 2001-024235 | 1/2001 |
| JP | 2003-515956 | 5/2003 |
| JP | 2003-529889 | 10/2003 |
| JP | 2004-080046 | 3/2004 |
| JP | 2004-103443 | 4/2004 |
| JP | 2004-253309 | 9/2004 |
| JP | 2004-286971 | 10/2004 |
| JP | 2004-356116 | 12/2004 |
| JP | 2004-363055 | 12/2004 |
| JP | 2005-142311 | 6/2005 |
| JP | 2006-344913 | 12/2006 |
| JP | 2007-059260 | 3/2007 |
| JP | 2007-141737 | 6/2007 |
| JP | 2007-141738 | 6/2007 |
| JP | 2007-200828 | 8/2007 |
| WO | 96/18210 | 6/1996 |
| WO | 98/43014 | 10/1998 |
| WO | 00/19546 | 4/2000 |
| WO | 00/34709 | 6/2000 |
| WO | 00/60562 | 10/2000 |
| WO | 01/41215 | 6/2001 |
| WO | 02/080625 A1 | 10/2002 |
| WO | 03/037042 | 5/2003 |
| WO | 2004/032235 | 4/2004 |
| WO | 2004/071141 | 8/2004 |
| WO | 2005/021323 | 3/2005 |
| WO | 2005/124877 | 12/2005 |
| WO | 2006/126124 | 11/2006 |
| WO | PCT/US2006/44519 | 11/2006 |
| WO | 2007/046026 | 4/2007 |
| WO | 2007/061758 | 5/2007 |
| WO | 2007/141748 | 12/2007 |
| WO | 2008/078240 | 7/2008 |

OTHER PUBLICATIONS

U.S. Appl. No. 11/614,180, filed Dec. 21, 2006.
U.S. Appl. No. 11/624,811, filed Jan. 19, 2007.
U.S. Appl. No. 11/626,483, filed Jan. 24, 2007.
U.S. Appl. No. 11/743,754, filed May 3, 2007.
U.S. Appl. No. 11/751,982, filed May 22, 2007.
U.S. Appl. No. 11/753,103, filed May 24, 2007.
U.S. Appl. No. 11/751,990, filed May 22, 2007.
U.S. Appl. No. 11/736,761, filed Apr. 18, 2007.
U.S. Appl. No. 11/736,799, filed Apr. 18, 2007.
U.S. Appl. No. 11/737,321, filed Apr. 19, 2007.
U.S. Appl. No. 11/755,153, filed May 30, 2007.
U.S. Appl. No. 11/755,162, filed May 30, 2007.
U.S. Appl. No. 11/856,421, filed Sep. 17, 2007.
U.S. Appl. No. 11/854,744, filed Sep. 13, 2007.
U.S. Appl. No. 11/859,048, filed Sep. 21, 2007.
U.S. Appl. No. 11/939,047, filed Nov. 13, 2007.
U.S. Appl. No. 11/936,163, filed Nov. 7, 2007.
U.S. Appl. No. 11/843,243, filed Aug. 22, 2007.
U.S. Appl. No. 11/948,021, filed Nov. 30, 2007.
U.S. Appl. No. 11/939,052, filed Nov. 13, 2007.
U.S. Appl. No. 11/939,059, filed Nov. 13, 2007.
U.S. Appl. No. 11/877,038, filed Oct. 23, 2007.
U.S. Appl. No. 12/248,220, filed Oct. 9, 2008.
U.S. Appl. No. 11/870,679, filed Oct. 11, 2007.
U.S. Appl. No. 11/951,626, filed Dec. 6, 2007.
U.S. Appl. No. 11/948,041, filed Nov. 30, 2007.
U.S. Appl. No. 12/114,994, filed May 5, 2008.
U.S. Appl. No. 12/116,341, filed May 7, 2008.
U.S. Appl. No. 12/117,148, filed May 8, 2008.
U.S. Appl. No. 12/117,280, filed May 8, 2008.
U.S. Appl. No. 12/017,676, filed Jan. 22, 2008.
U.S. Appl. No. 12/328,144, filed Dec. 4, 2008.
U.S. Appl. No. 12/116,346, filed May 7, 2008.
U.S. Appl. No. 12/116,348, filed May 7, 2008.
U.S. Appl. No. 11/755,149, filed May 30, 2007.
U.S. Appl. No. 11/601,295, filed Nov. 17, 2006.
U.S. Appl. No. 11/831,287, filed Jul. 31, 2007.
U.S. Appl. No. 11/751,263, filed May 21, 2007.
U.S. Appl. No. 11/958,721, filed Dec. 18, 2007.
U.S. Appl. No. 11/836,926, filed Aug. 10, 2007.
U.S. Appl. No. 11/674,855, filed Feb. 14, 2007.
U.S. Appl. No. 11/601,500, filed Nov. 17, 2006.
U.S. Appl. No. 11/368,976, filed Mar. 6, 2006.
U.S. Appl. No. 11/601,410, filed Nov. 17, 2006.
U.S. Appl. No. 11/751,364, filed May 21, 2007.
Zhu et al., "Optimizing the Performance of Remote Phosphor LED," First International Conference on White LEDs and Solid State Lighting.
Perduijn, "Light Output Feedback Solution for RGB LED Backlight Applications".
Summons to Attend Oral Proceedings from a corresponding European patent application bearing a mailing date of Jul. 2, 2013.
Deurenberg et al., *Achieving color point stability in RGB multi-chip LED modules using various color control loops*, Proceeding of the SPIE—The International Society for Optical Engineering, vol. 5941, Sep. 7, 2005, pp. 1-12.
Narendran et al., "Solid State lighting: failure analysis of white LEDs," Journal of Cystal Growth, vol. 268, Issues 1-4, Aug. 2004, Abstract.
Perduijn et al., *Light Output Feedback Solution for RGB LED Backlight Applications*, SID Digest (2000).
Zhu et al., *Optimizing the Performance of Remote Phosphor LED*, First International Conference on White LED's and Solid State Lighting, PW-48 (Nov. 26-30, 2007).
Cree, Inc., "Cree® Xlamp® 7090 XR-E Series LED Binning and Labeling," Application Note: CLD-AP08.000, 7pp (2006).
Van De Yen et al., "Warm White Illumination with High CRI and High Efficacy by Combining 455 nm Excited Yellowish Phosphor LEDs and Red A1InGaP LEDs," First International Conference on White LEDs and Solid State Lighting, Nov. 30, 2007.
Zhu at al., *Optimizing the Performance of Remote Phosphor LED*, First International Conference on White LED's and Solid State Lighting, PW-48 (Nov. 26-30, 2007).
Perduijn et al., *Light Output Feedback Solution for RGB LED Backlight Applications*, STD Digest (2000).
Zhu et al., *Optimizing the Performance of Remote Phosphor LED*, First International Conference on White LED's and Solid State Lighting. PW-48 (Nov. 26-30, 2007).

* cited by examiner

SOLID STATE LIGHTING DEVICES AND METHODS OF MANUFACTURING THE SAME

CROSS-REFERENCE TO RELATED APPLICATIONS

This application is a division of U.S. patent application Ser. No. 12/257,804, filed Oct. 24, 2008 (now U.S. Patent Publication No. 2009/0160363), the entirety of which is incorporated herein by reference as if set forth in its entirety.

This application claims the benefit of U.S. Provisional Patent Application No. 60/990,724, filed Nov. 28, 2007, the entirety of which is incorporated herein by reference.

This application claims the benefit of U.S. Provisional Patent Application No. 61/041,404, filed Apr. 1, 2008, the entirety of which is incorporated herein by reference.

FIELD OF THE INVENTIVE SUBJECT MATTER

The present inventive subject matter relates to a lighting device, in particular, a device which includes one or more solid state light emitters (e.g., light emitting diodes) and methods of manufacturing such devices.

BACKGROUND OF THE INVENTIVE SUBJECT MATTER

A large proportion (some estimates are as high as twenty-five percent) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about four) but are still less efficient than solid state light emitters, such as light emitting diodes.

In addition, as compared to the normal lifetimes of solid state light emitters, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes (e.g., 10,000-20,000 hours) than incandescent lights, but provide less favorable color reproduction.

Color reproduction is typically measured using the Color Rendering Index (CRI Ra). CRI Ra is a modified average of the relative measurement of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator. Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways. Driver response time, however, significantly decreases with lower CRI Ra values (for any given brightness, legibility decreases with lower CRI).

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Accordingly, for these and other reasons, efforts have been ongoing to develop ways by which solid state light emitters can be used in place of incandescent lights, fluorescent lights and other light-generating devices in a wide variety of applications. In addition, where solid state light emitters are already being used, efforts are ongoing to provide solid state light emitter-containing devices which are improved, e.g., with respect to energy efficiency, color rendering index (CRI Ra), contrast, efficacy (lm/W), and/or duration of service.

Light emitting diodes are well-known semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure. There are a number of well-known ways to make light emitting diodes and many associated structures, and the present inventive subject matter can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The commonly recognized and commercially available light emitting diode ("LED") that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

In general, the 1931 CIE Chromaticity Diagram (an international standard for primary colors established in 1931), and the 1976 CIE Chromaticity Diagram (similar to the 1931 Diagram but modified such that similar distances on the Diagram represent similar perceived differences in color) provide useful reference for defining colors as weighted sums of colors.

A wide variety of luminescent materials (and structures which contain luminescent materials, known as lumiphors or luminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear or translucent encapsulant material (e.g., epoxy-based, silicone-based, glass-based or metal oxide-based material) as discussed above, for example by a blending or coating process.

For example, U.S. Pat. No. 6,963,166 (Yano '166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

There is an ongoing need for ways to use solid state light emitters, e.g., light emitting diodes, to provide white light in a wider variety of applications, with greater energy efficiency, with improved color rendering index (CRI Ra), with more consistent color output, with improved efficacy (lm/W), with longer duration of service, and/or with relatively simple circuitry.

SUMMARY OF THE INVENTIVE SUBJECT MATTER

It would be desirable to be able to account for variability in manufacturing of LED light sources (and other solid state light emitters) while still providing products with a consistent color temperature. The present inventive subject matter is directed to lighting devices (and methods of making them) which provide consistent color temperature (and/or color output, i.e., the color coordinates on a CIE Chromaticity Diagram corresponding to the output of the lighting devices are consistent, for individual lighting devices and among different lighting devices) despite the possibility of variability in the light sources (e.g., solid state light emitters) included in such devices.

In some aspects, the present inventive subject matter accounts for variability in solid state light emitters by setting the color output of the device after manufacture and taking into account the specific solid state light emitters used in individual products, by assembling the lighting device, testing the lighting device, adjusting the currents supplied to various solid state light emitters, as needed, to achieve desired color output, and setting the current supplied to at least some of the strings of solid state light emitters. The color temperature may be permanently set by such a tuning process according to the present inventive subject matter. By providing a device with a plurality of light emitters which are selected such that light output from the device has x,y color coordinates (on a 1931 CIE Chromaticity Diagram) or u'v' coordinates (on a 1976 CIE Chromaticity Diagram) which approximate desired color coordinates, and by dividing some or all of the light emitters among three or more stings of light emitters, the device can be illuminated and the respective currents supplied through the respective strings can be adjusted in order to tune the device to output light which more closely approximates the desired color coordinates (i.e., even where the individual light emitters, e.g., solid state light emitters, deviate to some degree from their design output light color coordinates and/or lumen intensity).

In accordance with a first aspect of the present inventive subject matter, there is provided a lighting device, comprising:

at least a first string of solid state lighting devices, a second string of solid state lighting devices and a third string of solid state lighting devices;

at least a first power line;

means for supplying a first fixed current through the first string of solid state lighting devices when line voltage is supplied to the power line;

means for supplying a second fixed current through the second string of solid state lighting devices when line voltage is supplied to the power line; and means for supplying through the third string of solid state lighting devices a third string current.

In some embodiments according to the first aspect of the present inventive subject matter:

the means for supplying a first fixed current comprises a means for supplying a first fixed current which is based on:

- a hue of light output from the solid state lighting devices in the first string,
- a hue of light output from the solid state lighting devices in the second string,
- a hue of light output from the solid state lighting devices in the third string,
- a lumen output from the solid state lighting devices in the first string,
- a lumen output from the solid state lighting devices in the second string,
- a lumen output from the solid state lighting devices in the third string, and
- a target zone for the hue of the light output from the lighting device;

the means for supplying a second fixed current comprises a means for supplying a second fixed current which is based on:

- a hue of light output from the solid state lighting devices in the first string,
- a hue of light output from the solid state lighting devices in the second string,
- a hue of light output from the solid state lighting devices in the third string,
- a lumen output from the solid state lighting devices in the first string,
- a lumen output from the solid state lighting devices in the second string, a lumen output from the solid state lighting devices in the third string, and a target zone for the hue of the light output from the lighting device; and the means for supplying a third current comprises a means for supplying a third current which is based on:

a hue of light output from the solid state lighting devices in the first string, a hue of light output from the solid state lighting devices in the second string, a hue of light output from the solid state lighting devices in the third string, a lumen output from the solid state lighting devices in the first string, a lumen output from the solid state lighting devices in the second string, a lumen output from the solid state lighting devices in the third string, and a target zone for the hue of the light output from the lighting device.

In some of such embodiments, the means for supplying a first fixed current comprises a means for supplying a first fixed current which is further based on a target zone for the lumen output from the lighting device, the means for supplying a second fixed current comprises a means for supplying a second fixed current which is further based on a target zone for the lumen output from the lighting device, and the means for supplying a third current comprises a means for supplying a third current which is further based on a target zone for the lumen output from the lighting device.

The expression "line voltage", as set forth above, refers to any input voltage which is sufficient to allow a power supply to operate within its normal operating parameters. Such input voltage can be supplied from a power source to a power line, from which power is input to the power supply. The line voltage can be AC and/or DC voltage, depending on the specific configuration of the power supply.

The present specification also includes statements which read "if any line voltage is supplied to the power line, a first current would pass through each solid state light emitters in the first string of solid state light emitters", or the like, as well as statements that "a lighting device current setting is permanently established" or the like. Such statements indicate that the current through the string of solid state light emitters has been set so that whenever any line voltage is supplied to the power line (which supplies input power to the power supply), a specific current will pass through the string of solid state light emitters, despite any variance in the line voltage (i.e., the current will remain substantially the same even though the line voltage may vary within a range which allows the power supply to operate within its normal operating parameters). Persons skilled in the art are familiar with a variety of techniques for permanently establishing a current setting (i.e., setting the current through a string of solid state light emitters), and any of such techniques can be employed according to the present inventive subject matter. Such techniques include, for example, setting currents in a linear or pulse width modulated current regulated power supply by establishing reference voltages or currents or sensed currents of voltages through programmable registers, fusable links, zener zapping, laser trimming current sense or current limiting resistors or other techniques known to those of skill in the art. Examples of differing trimming techniques are described by Analog Devices website at:

"http://www.analog.com/en/amplifiers-and-comparators/operational-amplifiers-op-amps/products/technical-documentation/CU_td_DigiTrim_Technology/resources/fca.html."

Although the lighting devices in accordance with the present inventive subject matter (and the methods of making such lighting devices) are described in the present specification in terms of current that will flow when line voltage is supplied to a power line for the lighting device, the power supplied to the lighting devices in accordance with the present inventive subject matter can be altered in order to dim the light output from the lighting devices described herein. Persons of skill in the art are familiar with a variety of techniques for achieving dimming in various devices, and any of such techniques can be employed according to the present inventive subject matter. Representative examples of such techniques include altering the duty cycle of the power signal (e.g., with a triac), pulsing the signal, etc.

In some embodiments according to the first aspect of the present inventive subject matter:

the first string of solid state lighting devices comprises at least one solid state lighting device which, if power is supplied to the first string, emits light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, the second string of solid state lighting devices comprises at least one solid state lighting device which, if power is supplied to the second string, emits light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, and the third string of solid state lighting devices comprises at least one solid state lighting device which, if power is supplied to the third string, emits light having a dominant wavelength in the range of from about 600 nm to about 640 nm, e.g., between 610 nm and 635 nm, between 610 nm and 630 nm, between 615 nm and 625 nm (for example, around 612 nm, 615 nm, 618 nm, 619 nm, 620 nm or 622 nm).

In some embodiments according to the first aspect of the present inventive subject matter:

if power is supplied to the first string of solid state lighting devices, the hues of light emitted by each solid state lighting device on the first string fall within a first color bin;

if power is supplied to the second string of solid state lighting devices, the hues of light emitted by each solid state lighting device on the second string fall within a second color bin; and the first color bin is different from the second color bin. In some of such embodiments, the first color bin and the second color bin substantially do not overlap.

In some embodiments according to the first aspect of the present inventive subject matter, if current is supplied to a power line for the lighting device, a color of light exiting the lighting device has x, y coordinates on a 1931 CIE Chromaticity Diagram which define a point which is within 10 MacAdam ellipses (and in some embodiments, within 7 MacAdam ellipses, in some embodiments, within 5 MacAdam ellipses, and in some embodiments, within 4 MacAdam ellipses or less) of at least one point on the blackbody locus on a 1931 CIE Chromaticity Diagram.

In some embodiments according to the first aspect of the present inventive subject matter:

the third string of solid state lighting devices comprises at least one solid state lighting device which, if power is supplied to the third string, emits light having a dominant wavelength in the range of from about 600 nm to about 640 nm; and if current is supplied to a power line for the lighting device, a color of light exiting the lighting device has x, y coordinates on a 1931 CIE Chromaticity Diagram which define a point which is within 10 MacAdam ellipses (and in some embodiments, within 7 MacAdam ellipses, in some embodiments, within 5 MacAdam ellipses, and in some embodiments, within 4 MacAdam ellipses or less) of at least one point on the blackbody locus on a 1931 CIE Chromaticity Diagram.

In accordance with a second aspect of the present inventive subject matter, there is provided a lighting device, comprising:

at least a first string of solid state light emitters, a second string of solid state light emitters and a third string of solid state light emitters, the first string of solid state light emitters comprising at least one solid state light emitter which, if power is supplied to the first string, emits BSY light (defined below), the second string of solid state light emitters comprising at least one solid state light emitter which, if power is supplied to the second string, emits BSY light, the third string of solid state light emitters comprising at least one solid state light emitter which, if power is supplied to the third string, emits light having a dominant wavelength in the range of from about 600 nm to about 640 nm.

The expression "BSY", as used herein, means:

light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, or light having x, y color coordinates which define a point which is within an area on a 1931 CIE Chromaticity Diagram enclosed by first, second, third and fourth line segments, said first line segment connecting a first point to a second point, said second line segment connecting said second point to a third point, said third line segment connecting said third point to a fourth point, said fourth line segment connecting said fourth point to said first point, said first point having x, y coordinates of 0.32, 0.40, said second point having x, y coordinates of 0.36, 0.48, said third point having x, y coordinates of 0.41, 0.455, and said fourth point having x, y coordinates of 0.36, 0.38, i.e., the expression "BSY" as used herein has a definition which is the same as definitions of regions defined by specific color coordinates (on CIE Chromaticity Diagrams) set forth in U.S. Pat. No. 7,213,940, issued on May 8, 2007, entitled "LIGHTING DEVICE AND LIGHTING METHOD" (inventors: Antony Paul van de Ven and Gerald H. Negley), the entirety of which is hereby incorporated by reference and other family member applications (including U.S. Patent Application No. 60/868,134, filed on Dec. 1, 2006 and U.S. patent application Ser. No. 11/948,021 (now U.S. Patent Publication No. 2008/0130285), filed on Nov. 30, 2007), as well as other applications filed by and/or owned by the assignee of the present application (e.g., U.S. Patent Application No. 60/857,305, filed on Nov. 7, 2006, entitled "LIGHTING DEVICE AND LIGHTING METHOD" (inventors: Antony Paul van de Ven and Gerald H. Negley; and U.S. patent application Ser. No. 11/936,163 (now U.S. Patent Publication No. 2008/0106895), filed Nov. 7, 2007, the entireties of which are hereby incorporated by reference, U.S. Patent Application No. 60/978,880, filed on Oct. 10, 2007, entitled "LIGHTING DEVICE AND METHOD OF MAKING" (inventors: Antony Paul van de Ven and Gerald H. Negley) and U.S. Patent Application No. 61/037,365, filed on Mar. 18, 2008, the entireties of which are hereby incorporated by reference.

In some embodiments in accordance with the second aspect of the present inventive subject matter:

if power is supplied to the first string of solid state lighting devices, the hues of light emitted by each solid state lighting device on the first string fall within a first color bin;

if power is supplied to the second string of solid state lighting devices, the hues of light emitted by each solid state lighting device on the second string fall within a second color bin; and the first color bin is different from the second color bin. In some of such embodiments, the first color bin and the second color bin substantially do not overlap.

In some embodiments in accordance with the second aspect of the present inventive subject matter, the lighting device further comprises circuitry wherein:

if any line voltage is supplied to a power line for the lighting device, a current of a first value would pass through each of the solid state light emitters in the first string of solid state light emitters.

In some embodiments in accordance with the second aspect of the present inventive subject matter, the lighting device further comprises:

a sensor which senses an intensity of a mixture of at least (1) light emitted by the first string of solid state light emitters and (2) light emitted by the second string of solid state light emitters; and circuitry which adjusts a current supplied to the third string of solid state light emitters in response to the intensity of that mixture, i.e., in response to the intensity of the mixture of at least (1) light emitted by the first string of solid state light emitters and (2) light emitted by the second string of solid state light emitters.

In some embodiments in accordance with the second aspect of the present inventive subject matter, the lighting device further comprises a power line, and if current is supplied to the power line, the color of light exiting the lighting device has x, y coordinates on a 1931 CIE Chromaticity Diagram which define a point which is within 10 MacAdam ellipses (and in some embodiments, within 7 MacAdam ellipses, in some embodiments, within 5 MacAdam ellipses, and in some embodiments, within 4 MacAdam ellipses or less) of at least one point on the blackbody locus on a 1931 CIE Chromaticity Diagram.

In accordance with a third aspect of the present inventive subject matter, there is provided a method of making a lighting device, the method comprising:

measuring a first color output of a lighting device while supplying (1) a first string initial current to a first string of solid state light emitters, (2) a second string initial current to a second string of solid state light emitters and (3) a third string initial current to a third string of solid state light emitters, the lighting device comprising at least the first string of solid state light emitters, the second string of solid state light emitters, the third string of solid state light emitters and a power line, adjusting the current supplied to at least one of the first string of solid state light emitters, the second string of solid state light emitters and the third string of solid state light emitters such that a first string final current is supplied to the first string of solid state light emitters, a second string final current is supplied to the second string of solid state light emitters and a third string final current is supplied to the third string of solid state light emitters;

permanently setting the first string of solid state light emitters, such that if any line voltage is supplied to the power line, the first string final current will be supplied to the first string of solid state light emitters; and permanently setting the second string of solid state light emitters, such that if any line voltage is supplied to the power line, the second string final current will be supplied to the second string of solid state light emitters.

In some embodiments in accordance with the third aspect of the present inventive subject matter, the method further comprises setting the third string final current relative to the intensity of a mixture of light emitted by at least the first string of solid state lighting devices and the second string of solid state lighting devices.

In some embodiments in accordance with the third aspect of the present inventive subject matter, the method further comprises setting the third string final current relative to the intensity of a mixture of light emitted by all solid state lighting devices in the lighting device which emit BSY light.

In some embodiments in accordance with the third of the present inventive subject matter:

the first string of solid state light emitters comprises at least one solid state light emitter which, if power is supplied to the first string, emits light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38;

the second string of solid state light emitters comprises at least one solid state light emitter which, if power is supplied to the second string, emits light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38; and the third string of solid state light emitters comprises at least one solid state light emitter which, if power is supplied to the third string, emits light having a dominant wavelength in the range of from about 600 nm to about 640 nm.

In some embodiments in accordance with the third aspect of the present inventive subject matter, after adjusting the current supplied to at least one of the first string of solid state light emitters, the second string of solid state light emitters and the third string of solid state light emitters, a color of a mixture of light emitted by the lighting device corresponds to a point on a 1976 CIE Chromaticity Diagram having u', v' coordinates in which the u' coordinate is within a predetermined u' coordinate range and the v' coordinate is within a predetermined v' coordinate range.

In some embodiments in accordance with the present inventive subject matter, the "target" u', v' coordinates are obtained by defining a specific maximum spacing from a point along the blackbody locus. For example, in some embodiments according to the present inventive subject matter, the target ranges for u', v' are v' points which are within 0.0025 Eu'v' of a DOE specification color temperature point, e.g., 2700 K (x, y coordinates are 0.4578, 0.4101—persons skilled in the art can readily convert x, y coordinates to u', v' coordinates), 3000 K (x, y coordinates are 0.4338, 0.4030) or 3500 K (x, y coordinates are 0.4073, 0.3814).

In some embodiments in accordance with the third aspect of the present inventive subject matter, the method further comprises supplying current to (1) the first string of solid state light emitters, (2) the second string of solid state light emitters and (3) the third string of solid state light emitters for at least a period of time which is sufficient that any additional changes in temperature caused by continued operation of the lighting device does not result in a difference in color output that would be perceivable by a person with average eyesight.

In some embodiments in accordance with the third aspect of the present inventive subject matter, adjusting the current supplied to at least one of the first string of solid state light emitters, the second string of solid state light emitters and the third string of solid state light emitters comprises:

adjusting the current supplied to the third string of solid state light emitters to a third string adjusted current;

then measuring a second color output of the lighting device while supplying the first string initial current to the first string of solid state light emitters, the second string initial current to the second string of solid state light emitters and the third string adjusted current to the third string of solid state light emitters; and then increasing the current supplied to the first string of solid state light emitters to a first string adjusted current and decreasing the current supplied to the second string of solid state light emitters to a second string adjusted current. In some such embodiments:

after adjusting the current supplied to the third string of solid state light emitters to a third string adjusted current, a color of a mixture of light emitted by the lighting device corresponds to a point on a 1976 CIE Chromaticity Diagram having u', v' coordinates in which the u' coordinate is within a predetermined u' coordinate range, and after increasing the current supplied to the first string of solid state light emitters to a first string adjusted current and decreasing the current supplied to the second string of solid state light emitters to a second string adjusted current, a color of a mixture of light emitted by the lighting device corresponds to a point on a 1976 CIE Chromaticity Diagram having u', v' coordinates in which the v' coordinate is within a predetermined v' coordinate range.

In some embodiments in accordance with the third aspect of the present inventive subject matter, the method further comprises:

measuring lumen output by the lighting device after adjusting the current supplied to the third string of solid state light emitters to a third string adjusted current; and proportionately adjusting the current supplied to the first string of solid state light emitters, the current supplied to the second string of solid state light emitters and the current supplied to the third string of solid state light emitters after adjusting the current supplied to the third string of solid state light emitters to a third string adjusted current.

The expression "proportionately adjusting the current supplied to the first string of solid state light emitters, the current supplied to the second string of solid state light emitters and the current supplied to the third string of solid state light emitters", and similar statements herein, indicates that if a ratio of the current supplied to one string relative to the current supplied to another string before proportionately adjusting the current, the ratio is substantially the same after proportionately adjusting the current.

In some embodiments in accordance with the third aspect of the present inventive subject matter, the method further comprises:

measuring lumen output by the lighting device after increasing the current supplied to the first string of solid state light emitters to a first string adjusted current and decreasing the current supplied to the second string of solid state light emitters to a second string adjusted current; and proportionately adjusting the current supplied to the first string of solid state light emitters, the current supplied to the second string of solid state light emitters and the current supplied to the third string of solid state light emitters after increasing the current supplied to the first string of solid state light emitters to a first string adjusted current and decreasing the current supplied to the second string of solid state light emitters to a second string adjusted current.

In some embodiments in accordance with the third aspect of the present inventive subject matter, adjusting the current supplied to at least one of the first string of solid state light emitters, the second string of solid state light emitters and the third string of solid state light emitters comprises:

adjusting the current supplied to the third string of solid state light emitters to a third string adjusted current;

then measuring a second color output of the lighting device while supplying the first string initial current to the first string of solid state light emitters, the second string initial current to the second string of solid state light emitters and the third string adjusted current to the third string of solid state light emitters, then adjusting the current supplied to the first string of solid state light emitters to a first string adjusted current and/or adjusting the current supplied to the second string of solid state light emitters to a second string adjusted current. In some of such embodiments:

after adjusting the current supplied to the third string of solid state light emitters to a third string adjusted current, a color of a mixture of light emitted by the lighting device corresponds to a point on a 1976 CIE Chromaticity Diagram having u', v' coordinates in which the u' coordinate is within a predetermined u' coordinate range, and after adjusting the current supplied to the first string of solid state light emitters to a first string adjusted current and/or adjusting the current supplied to the second string of solid state light emitters to a second string adjusted current, a color of a mixture of light emitted by the lighting device corresponds to a point on a 1976 CIE Chromaticity Diagram having u', v' coordinates in which the v' coordinate is within a predetermined v' coordinate range.

In some embodiments in accordance with the third aspect of the present inventive subject matter, the method further comprises:

measuring lumen output by the lighting device after adjusting the current supplied to the third string of solid state light emitters to a third string adjusted current; and proportionately adjusting the current supplied to the first string of solid state light emitters, the current supplied to the second string of solid state light emitters and the current supplied to the third string of solid state light emitters after adjusting the current supplied to the third string of solid state light emitters to a third string adjusted current.

In some embodiments in accordance with the third aspect of the present inventive subject matter, the method further comprises:

measuring lumen output by the lighting device after adjusting the current supplied to the first string of solid state light emitters to a first string adjusted current and/or adjusting the current supplied to the second string of solid state light emitters to a second string adjusted current; and proportionately adjusting the current supplied to the first string of solid state light emitters, the current supplied to the second string of solid state light emitters and the current supplied to the third string of solid state light emitters after adjusting the current supplied to the first string of solid state light emitters to a first string adjusted current and/or adjusting the current supplied to the second string of solid state light emitters to a second string adjusted current.

In some embodiments in accordance with the third aspect of the present inventive subject matter, after permanently setting the first string of solid state light emitters and the second string of solid state light emitters, if current is supplied to a power line of the lighting device, a color of light exiting the lighting device will have x, y coordinates on a 1931 CIE Chromaticity Diagram which define a point which is within 10 MacAdam ellipses (and in some embodiments, within 7 MacAdam ellipses, in some embodiments, within 5 MacAdam ellipses, and in some embodiments, within 4 MacAdam ellipses or less) of at least one point on the blackbody locus on a 1931 CIE Chromaticity Diagram.

BRIEF DESCRIPTION OF THE DRAWING FIGURES

DETAILED DESCRIPTION OF THE INVENTIVE SUBJECT MATTER

Figure 1:
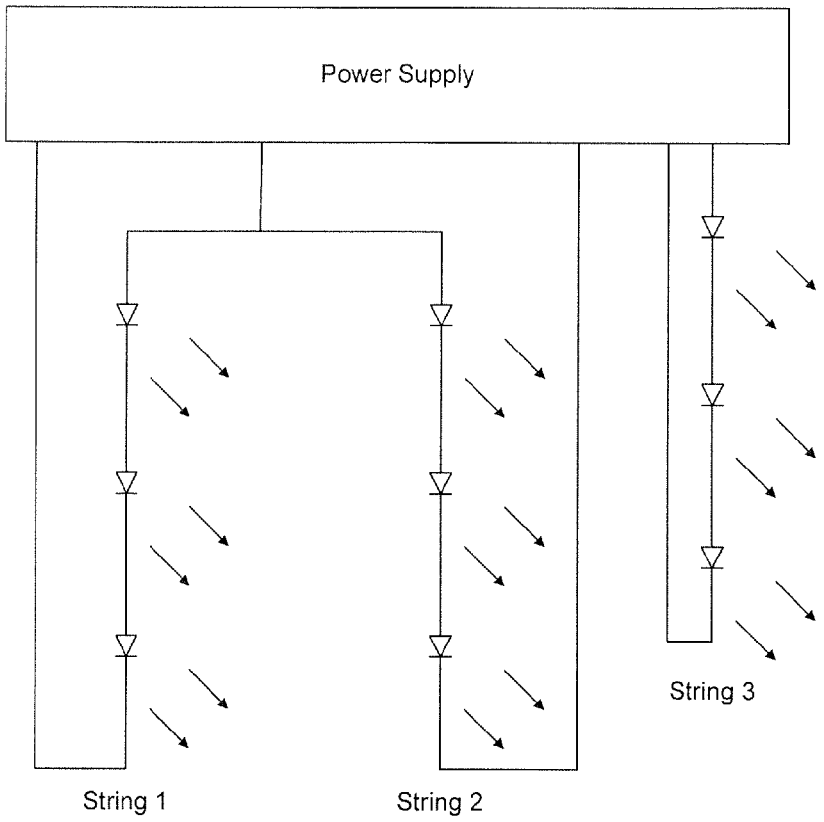
FIG. 1 is a drawing of the overall configuration of the power supply and the LED strings for the first representative embodiment of a lighting device in accordance with the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

The expression "after", as used herein, e.g., in the expression "measuring lumen output by the lighting device after adjusting the current supplied to the third string of solid state light emitters to a third string adjusted current" means that the later event (i.e., the event which occurs "after" another "prior event") does not occur until after the prior event has occurred, but not necessarily directly or immediately after the prior event (although it can occur directly or immediately after the prior event), i.e., one or more events and/or passages of time can occur between the prior event and the later event.

Similarly, the expression "then", as used herein, e.g., in the expression "then measuring a second color output of the lighting device" indicates that the event which follows the term "then" occurs after the event which precedes the term "then", but not necessarily directly or immediately after (although it can occur directly or immediately after the prior event), i.e., one or more events and/or passages of time can occur between the event which precedes the term "then" (the prior event) and the event which follows the term "then" (the later event).

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The expression "illumination" (or "illuminated"), as used herein when referring to a solid state light emitter, means that at least some current is being supplied to the solid state light emitter to cause the solid state light emitter to emit at least some light. The expression "illuminated" encompasses situations where the solid state light emitter emits light continuously or intermittently at a rate such that a human eye would perceive it as emitting light continuously, or where a plurality of solid state light emitters of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "excited", as used herein when referring to a luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously or intermittently at a rate such that a human eye would perceive it as emitting light continuously, or where a plurality of luminescent materials of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "dominant wavelength", is used herein according to its well-known and accepted meaning to refer to the perceived color of a spectrum, i.e., the single wavelength of light which produces a color sensation most similar to the color sensation perceived from viewing light emitted by the light source (i.e., it is roughly akin to "hue"), as opposed to "peak wavelength", which is well-known to refer to the spectral line with the greatest power in the spectral power distribution of the light source. Because the human eye does not perceive all wavelengths equally (it perceives yellow and green better than red and blue), and because the light emitted by many solid state light emitters (e.g., LEDs) is actually a range of wavelengths, the color perceived (i.e., the dominant wavelength) is not necessarily equal to (and often differs from) the wavelength with the highest power (peak wavelength). A truly monochromatic light such as a laser has the same dominant and peak wavelengths.

As used herein, the term "substantially," where quantifiable (e.g., "the current is substantially the same"), means at least about 95% correspondence.

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

Aspects related to the present inventive subject matter can be represented on either the 1931 CIE (Commission International de l'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). For a technical description of CIE chromaticity diagrams, see, for example, "Encyclopedia of Physical Science and Technology", vol. 7, 230-231 (Robert A Meyers ed., 1987). The spectral colors are distributed around the edge of the outlined space, which includes all of the hues perceived by the human eye. The boundary line represents maximum saturation for the spectral colors. As noted above, the 1976 CIE Chromaticity Diagram is similar to the 1931 Diagram, except that the 1976 Diagram has been modified such that similar distances on the Diagram represent similar perceived differences in color.

In the 1931 Diagram, deviation from a point on the Diagram can be expressed either in terms of the coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues which would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$, and the hues defined by a locus of points which are each a common distance from a specified hue consist of hues which would each be perceived as differing from the specified hue to a common extent.

The chromaticity coordinates (i.e., color points) that lie along the blackbody locus obey Planck's equation: $E(\lambda)=A\lambda^{-5}/(e^{(B/T)}-1)$, where E is the emission intensity, $\lambda$ is the emission wavelength, T the color temperature of the blackbody and A and B are constants. Color coordinates that lie on or near the blackbody locus yield pleasing white light to a human observer. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants which produce light which is on or near the blackbody locus can thus be described in terms of their color temperature.

As mentioned above, in accordance with a second aspect of the present inventive subject matter, there is provided a lighting device, comprising at least a first string of solid state light emitters, a second string of solid state light emitters and a third string of solid state light emitters. The expression "string", as used herein, refers to a conductive element on which one or more solid state light emitter are provided in series, such that if current is supplied to the string, the current passes sequentially through each of the solid state light emitters in the string.

The expression "power line", as used herein, refers to a conductive element through which electrical power can be supplied. Persons of skill in the art are familiar with a wide variety of elements which can function as a power line, and any of such elements can be employed in making the devices or performing the methods in accordance with the present inventive subject matter.

In some instances in the present specification, a string (or strings) is referred to as a string of a particular color or hue, e.g., a "red string" or a "BSY string". Such expressions indicate a string of solid state light emitters in which most or all of the solid state light emitters in the string emit light of the particular color (or hue). That is, a string which is referred to as a string of a particular color or hue can include some solid state light emitters (e.g., not more than 25% of the solid state light emitters, in some cases not more than 10% of the solid state light emitters, in some cases not more than 5% of the solid state light emitters, and in some cases none of the solid state light emitters) which emit light of a different color.

Similarly, in some instances in the present specification, a solid state light emitter (or group of solid state light emitters) is referred to as a solid state light emitter of a particular color or hue, e.g., a "red solid state light emitter" or a "BSY solid state light emitter". Such expressions indicate a solid state light emitter which, when illuminated, emits light of the particular color.

Each string can include any desired number of solid state light emitters, e.g., a single solid state light emitter, five solid state light emitters, twenty-five solid state light emitters, one hundred solid state light emitters, etc.

The solid state light emitters in the lighting devices and methods of the present inventive subject matter can be arranged in any desired pattern, e.g., in any of the patterns described in U.S. Pat. No. 7,213,940, issued on May 8, 2007, entitled "LIGHTING DEVICE AND LIGHTING METHOD" (inventors: Antony Paul van de Ven and Gerald H. Negley), the entirety of which is hereby incorporated by reference.

The expression "solid state light emitter", as used herein, refers to any solid state device which, when illuminated and/or excited, emits light. A wide variety of solid state light emitters are well-known to those of skill in the art, and any such solid state light emitters can be employed in the lighting devices and methods according to the present inventive subject matter. For example, a solid state light emitter according to the present inventive subject matter can comprise a light emitting diode, optionally further comprising a luminescent material.

The solid state light emitters can be saturated or non-saturated. The term "saturated", as used herein, means having a purity of at least 85%, the term "purity" having a well-known meaning to persons skilled in the art, and procedures for calculating purity being well-known to those of skill in the art.

A wide variety of light emitting diodes are well-known to those of skill in the art, and any of such light emitting diodes can be used in the lighting devices and methods according to the present inventive subject matter. A wide variety of luminescent materials are well-known to those of skill in the art, and any of such luminescent materials can be used in the lighting devices and methods according to the present inventive subject matter.

Representative examples of suitable light emitting diodes (which, as mentioned above, can optionally include one or more luminescent materials) which can be used in lighting devices and methods according to the present inventive subject matter are described in U.S. Patent Application No. 60/753,138, filed on Dec. 22, 2005, entitled "LIGHTING DEVICE" (inventor: Gerald H. Negley) and U.S. patent application Ser. No. 11/614,180 (now U.S. Patent Publication No. 2007/0236911), filed Dec. 21, 2006, the entireties of which are hereby incorporated by reference;

U.S. Patent Application No. 60/794,379, filed on Apr. 24, 2006, entitled "SHIFTING SPECTRAL CONTENT IN LEDS BY SPATIALLY SEPARATING LUMIPHOR FILMS" (inventors: Gerald H. Negley and Antony Paul van de Ven) and U.S. patent application Ser. No. 11/624,811 (now U.S. Patent Publication No. 2007/0170447), filed Jan. 19, 2007, the entireties of which are hereby incorporated by reference;

U.S. Patent Application No. 60/808,702, filed on May 26, 2006, entitled "LIGHTING DEVICE" (inventors: Gerald H. Negley and Antony Paul van de Ven) and U.S. patent application Ser. No. 11/751,982 (now U.S. Patent Publication No. 2007/0274080), filed May 22, 2007, the entireties of which are hereby incorporated by reference;

U.S. Patent Application No. 60/808,925, filed on May 26, 2006, entitled "SOLID STATE LIGHT EMITTING DEVICE AND METHOD OF MAKING SAME" (inventors: Gerald H. Negley and Neal Hunter) and U.S. patent application Ser. No. 11/753,103 (now U.S. Patent Publication No. 2007/0280624), filed May 24, 2007, the entireties of which are hereby incorporated by reference;

U.S. Patent Application No. 60/802,697, filed on May 23, 2006, entitled "LIGHTING DEVICE AND METHOD OF MAKING" (inventor: Gerald H. Negley) and U.S. patent application Ser. No. 11/751,990 (now U.S. Patent Publication No. 2007/0274063), filed May 22, 2007, the entireties of which are hereby incorporated by reference;

U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761 (now U.S. Patent Publication No. 2007/0278934), filed Apr. 18, 2007, the entireties of which are hereby incorporated by reference;

U.S. Patent Application No. 60/857,305, filed on Nov. 7, 2006, entitled "LIGHTING DEVICE AND LIGHTING METHOD" (inventors: Antony Paul van de Ven and Gerald H. Negley; and U.S. patent application Ser. No. 11/936,163 (now U.S. Patent Publication No. 2008/0106895), filed Nov. 7, 2007, the entireties of which are hereby incorporated by reference;

U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243 (now U.S. Patent Publication No. 2008/0084685), filed Aug. 22, 2007, the entireties of which are hereby incorporated by reference;

U.S. Patent Application No. 60/851,230, filed on Oct. 12, 2006, entitled "LIGHTING DEVICE AND METHOD OF MAKING SAME" (inventor: Gerald H. Negley) and U.S. patent application Ser. No. 11/870,679 (now U.S. Patent Publication No. 2008/0089053), filed Oct. 11, 2007, the entireties of which are hereby incorporated by reference;

U.S. Patent Application No. 60/916,608, filed on May 8, 2007, entitled "LIGHTING DEVICE AND LIGHTING METHOD" (inventors: Antony Paul van de Ven and Gerald H. Negley), and U.S. patent application Ser. No. 12/117,148 (now U.S. Patent Publication No. 2008/0304261), filed May 8, 2008, the entireties of which are hereby incorporated by reference; and U.S. patent application Ser. No. 12/017,676 (now U.S. Patent Publication No. 2009/0108269), filed on Jan. 22, 2008, entitled "ILLUMINATION DEVICE HAVING ONE OR MORE LUMIPHORS, AND METHODS OF FABRICATING SAME" (inventors: Gerald H. Negley and Antony Paul van de Ven), U.S. Patent Application No. 60/982,900, filed on Oct. 26, 2007 (inventors: Gerald H. Negley and Antony Paul van de Ven), the entirety of which is hereby incorporated by reference.

For example, solid state light emitters in the form of LEDs which each include a light emitting diode which, when illuminated, emits light having a dominant wavelength in the range of from 430 nm to 480 nm and a luminescent material which, when excited, emits light having a dominant wavelength in the range of from 555 nm to 585 nm are suitable for use as the BSY solid state light emitters in the first and second strings in some embodiments of lighting devices according to the present inventive subject matter.

As noted above, in some embodiments according to the present inventive subject matter:

if power is supplied to the first string of solid state lighting devices, the hues of light emitted by each solid state lighting device on the first string fall within a first color bin;

if power is supplied to the second string of solid state lighting devices, the hues of light emitted by each solid state lighting device on the second string fall within a second color bin; and the first color bin is different from the second color bin. In some of such embodiments, the first color bin and the second color bin substantially do not overlap.

The use of solid state light emitters which emit light within different color bins is described in:

U.S. Patent Application No. 60/793,518, filed on Apr. 20, 2006, entitled "LIGHTING DEVICE AND LIGHTING METHOD" (inventors: Gerald H. Negley and Antony Paul van de Ven) and U.S. patent application Ser. No. 11/736,799 (now U.S. Patent Publication No. 2007/0267983), filed Apr. 18, 2007, the entireties of which are hereby incorporated by reference;

U.S. Patent Application No. 60/793,530, filed on Apr. 20, 2006, entitled "LIGHTING DEVICE AND LIGHTING METHOD" (inventors: Gerald H. Negley and Antony Paul van de Ven) and U.S. patent application Ser. No. 11/737,321

(now U.S. Patent Publication No. 2007/0278503), filed Apr. 19, 2007, the entireties of which are hereby incorporated by reference; and U.S. Patent Application No. 60/978,880, filed on Oct. 10, 2007, entitled "LIGHTING DEVICE AND METHOD OF MAKING" (inventors: Antony Paul van de Ven and Gerald H. Negley) and U.S. Patent Application No. 61/037,365, filed on Mar. 18, 2008, the entireties of which are hereby incorporated by reference.

The concepts of providing respective strings of BSY LEDs of differing respective bins and setting currents supplied to those strings, and of controlling current through respective strings to maintain color output despite, e.g., aging or variation of temperature response are described in:

U.S. Patent Application No. 60/978,880, filed on Oct. 10, 2007, entitled "LIGHTING DEVICE AND METHOD OF MAKING" (inventors: Antony Paul van de Ven and Gerald H. Negley) and U.S. Patent Application No. 61/037,365, filed on Mar. 18, 2008, the entireties of which are hereby incorporated by reference; and U.S. Patent Application No. 60/943,910, filed on Jun. 14, 2007, entitled "DEVICES AND METHODS FOR POWER CONVERSION FOR LIGHTING DEVICES WHICH INCLUDE SOLID STATE LIGHT EMITTERS" (inventor: Peter Jay Myers), and U.S. patent application Ser. No. 12/117,280 (now U.S. Patent Publication No. 2008/0309255), filed May 8, 2008, the entireties of which are hereby incorporated by reference.

Table 1 below provides representative examples of color bins which would be suitable for use according to the present inventive subject matter. Each of the bins (XA, XB, XC, XD, XE, XF, XG, XH, XJ, XK, XM, XN and XP) is four-sided, with the sides being defined by the listed x,y coordinates of the four corners of the bins. Other color bins can readily be envisioned and are encompassed by the present inventive subject matter. Representative combinations of the bins set forth in Table 1 include (XN, XF), (XM, XE), (XA, XD), (XB, XC), (XC, XK), (XD, XJ), (XE, XH) and (XF, XG). For each combination of bins, at least a portion of a tie line between the combined color output of the solid state light emitters on the first string and the combined color output of the solid state light emitters on the second string can be within a region defined by the outer perimeter of a shape which surrounds the color bins.

TABLE 1

| Chromaticity Region Bounding Coordinates | | |
|---|---|---|
| Region | x | y |
| XA | 0.3697 | 0.4738 |
| | 0.4008 | 0.4584 |
| | 0.3953 | 0.4487 |
| | 0.3640 | 0.4629 |
| XB | 0.3640 | 0.4629 |
| | 0.3953 | 0.4487 |
| | 0.3892 | 0.438 |
| | 0.3577 | 0.4508 |
| XC | 0.3577 | 0.4508 |
| | 0.3892 | 0.4380 |
| | 0.3845 | 0.4296 |
| | 0.3528 | 0.4414 |
| XD | 0.3528 | 0.4414 |
| | 0.3845 | 0.4296 |
| | 0.3798 | 0.4212 |
| | 0.3479 | 0.4320 |
| XE | 0.3479 | 0.4320 |
| | 0.3798 | 0.4212 |
| | 0.3747 | 0.4122 |
| | 0.3426 | 0.4219 |

TABLE 1-continued

| Chromaticity Region Bounding Coordinates | | |
|---|---|---|
| Region | x | y |
| XF | 0.3426 | 0.4219 |
| | 0.3747 | 0.4122 |
| | 0.3696 | 0.4031 |
| | 0.3373 | 0.4118 |
| XG | 0.3373 | 0.4118 |
| | 0.3696 | 0.4031 |
| | 0.3643 | 0.3937 |
| | 0.3318 | 0.4013 |
| XH | 0.3318 | 0.4013 |
| | 0.3643 | 0.3937 |
| | 0.3590 | 0.3843 |
| | 0.3263 | 0.3908 |
| XJ | 0.3263 | 0.3908 |
| | 0.3590 | 0.3843 |
| | 0.3543 | 0.3759 |
| | 0.3215 | 0.3815 |
| XK | 0.3215 | 0.3815 |
| | 0.3543 | 0.3759 |
| | 0.3496 | 0.3675 |
| | 0.3166 | 0.3722 |
| XM | 0.3762 | 0.4863 |
| | 0.4070 | 0.4694 |
| | 0.4008 | 0.4584 |
| | 0.3697 | 0.4738 |
| XN | 0.3836 | 0.5004 |
| | 0.4140 | 0.4819 |
| | 0.4070 | 0.4694 |
| | 0.3762 | 0.4863 |
| XP | 0.3920 | 0.5164 |
| | 0.4219 | 0.4960 |
| | 0.4140 | 0.4819 |
| | 0.3836 | 0.5004 |

As noted above, in some embodiments according to the present inventive subject matter, the lighting device further comprises a sensor which detects an intensity of light emitted by one or more strings of solid state light emitters, and circuitry which adjusts a current supplied to one or more strings of solid state light emitters in response to that intensity. Persons of skill in the art are familiar with a variety of sensors which can detect an intensity of light emitted by one or more solid state light emitters, and any of such sensors can be used in making or carrying out such embodiments. Similarly, persons of skill in the art are familiar with a variety of types of circuitry which can adjust a current supplied to one or more strings of solid state light emitters in response to intensity detected by the sensor(s), and any of such types of circuitry can be employed in the devices and methods according to the present inventive subject matter. For example, in some embodiments according to the present inventive subject matter, the current supplied to the third string of solid state lighting devices can be set to a particular value for the intensity of the combined light emitted by the solid state lighting devices in the first and second strings of solid state lighting devices as detected during testing (i.e., their initial combined intensity), and the current supplied to the third string can be varied (linearly or non-linearly) from that set value in response to variance in the intensity of the combined light emitted by the solid state lighting devices in the first and second strings of solid state lighting devices over time (e.g., as the intensity of the solid state lighting devices in the first and second strings of solid state lighting devices decreases over time, the current supplied to the third string of solid state lighting devices can be varied in order to reduce or minimize deviation of the combined color output of the lighting device over time. Skilled artisans are familiar with a variety of ways to provide such a relation-ship, e.g., by providing a sensor feedback which, in response to variances in the intensity of the combined light emitted by the solid state lighting devices in the first and second strings of solid state lighting devices, adjusts a reference voltage for the third string.

The third aspect of the present inventive subject matter includes measuring color output of a lighting device while supplying current to one or more strings of solid state light emitters, and adjusting the current supplied to at least one of the first string of solid state light emitters. Persons of skill in the art are familiar with a variety of devices and techniques for measuring color output, and any of such devices and techniques can be employed in the devices and methods according to the present inventive subject matter. Similarly, persons of skill in the art are familiar with a wide variety of devices and techniques for adjusting current supplied to one or more strings of solid state light emitters, and any of such devices and techniques can be employed in the devices and methods according to the present inventive subject matter. Thus, the currents are tunable based upon characteristics of the specific device (and components thereof) being used.

As noted above, some embodiments according to the present inventive subject matter comprise supplying current to one or more of the strings of solid state light emitters in a device prior to measuring a first color output, in order to allow the solid state light emitters to heat up to (or near to) a temperature to which they will typically be heated when the lighting device is illuminated, in order to account for variance in intensity of some solid state light emitters resulting from variance in temperature (e.g., the intensity of many solid state light emitters decreases as temperature increases, in at least some temperature ranges). The particular duration that current should be supplied to the solid state light emitters (prior to measuring the first color output) will depend on the particular configuration of the lighting device. For example, the greater the thermal mass the longer it will take for the solid state light emitters to approach their thermal equilibrium operating temperature. While a specific time for operating the lighting device prior to testing may be lighting device specific, in some embodiments, durations of from about 1 to about 60 minutes or more and, in specific embodiments, about 30 minutes, may be used.

In some lighting devices according to the present inventive subject matter, there are further included one or more circuitry components, e.g., drive electronics for supplying and controlling current passed through at least one of the one or more solid state light emitters in the lighting device. Persons of skill in the art are familiar with a wide variety of ways to supply and control the current passed through solid state light emitters, and any such ways can be employed in the devices of the present inventive subject matter. For example, such circuitry can include at least one contact, at least one leadframe, at least one current regulator, at least one power control, at least one voltage control, at least one boost, at least one capacitor and/or at least one bridge rectifier, persons of skill in the art being familiar with such components and being readily able to design appropriate circuitry to meet whatever current flow characteristics are desired. For example, circuitry which may be used in practicing the present inventive subject matter is described in:

U.S. Patent Application No. 60/752,753, filed on Dec. 21, 2005, entitled "LIGHTING DEVICE" (inventors: Gerald H. Negley, Antony Paul van de Ven and Neal Hunter) and U.S. patent application Ser. No. 11/613,692 (now U.S. Patent Publication No. 2007/0139923), filed Dec. 20, 2006, the entireties of which are hereby incorporated by reference;

U.S. Patent Application No. 60/809,959, filed on Jun. 1, 2006, entitled "LIGHTING DEVICE WITH COOLING" (inventors: Thomas G. Coleman, Gerald H. Negley and Antony Paul van de Ven) and U.S. patent application Ser. No. 11/626,483 (now U.S. Patent Publication No. 2007/0171145), filed Jan. 24, 2007, the entireties of which are hereby incorporated by reference;

U.S. Patent Application No. 60/798,446, filed on May 5, 2006, entitled "LIGHTING DEVICE" (inventor: Antony Paul van de Ven) and U.S. patent application Ser. No. 11/743,754 (now U.S. Patent Publication No. 2007/0263393), filed May 3, 2007, the entireties of which are hereby incorporated by reference;

U.S. Patent Application No. 60/809,595, filed on May 31, 2006, entitled "LIGHTING DEVICE AND METHOD OF LIGHTING" (inventor: Gerald H. Negley) and U.S. patent application Ser. No. 11/755,162 (now U.S. Patent Publication No. 2007/0279440), filed May 30, 2007, the entireties of which are hereby incorporated by reference;

U.S. Patent Application No. 60/844,325, filed on Sep. 13, 2006, entitled "BOOST/FLYBACK POWER SUPPLY TOPOLOGY WITH LOW SIDE MOSFET CURRENT CONTROL" (inventor: Peter Jay Myers), and U.S. patent application Ser. No. 11/854,744 (now U.S. Patent Publication No. 2008/0088248), filed Sep. 13, 2007, entitled "CIRCUITRY FOR SUPPLYING ELECTRICAL POWER TO LOADS", the entireties of which are hereby incorporated by reference;

U.S. Patent Application No. 60/943,910, filed on Jun. 14, 2007, entitled "DEVICES AND METHODS FOR POWER CONVERSION FOR LIGHTING DEVICES WHICH INCLUDE SOLID STATE LIGHT EMITTERS" (inventor: Peter Jay Myers), and U.S. patent application Ser. No. 12/117,280 (now U.S. Patent Publication No. 2008/0309255), filed May 8, 2008, the entireties of which are hereby incorporated by reference; and U.S. Patent Application No. 61/022,886, filed on Jan. 23, 2008, entitled "FREQUENCY CONVERTED DIMMING SIGNAL GENERATION" (inventors: Peter Jay Myers, Michael Harris and Terry Given) and U.S. Patent Application No. 61/039,926, filed Mar. 27, 2008, the entireties of which are hereby incorporated by reference.

In addition, persons of skill in the art are familiar with a wide variety of mounting structures for many different types of lighting, and any such structures can be used according to the present inventive subject matter.

For example, fixtures, other mounting structures and complete lighting assemblies which may be used in practicing the present inventive subject matter are described in:

U.S. Patent Application No. 60/752,753, filed on Dec. 21, 2005, entitled "LIGHTING DEVICE" (inventors: Gerald H. Negley, Antony Paul van de Ven and Neal Hunter) and U.S. patent application Ser. No. 11/613,692 (now U.S. Patent Publication No. 2007/0139923), filed Dec. 20, 2006, the entireties of which are hereby incorporated by reference;

U.S. Patent Application No. 60/798,446, filed on May 5, 2006, entitled "LIGHTING DEVICE" (inventor: Antony Paul van de Ven) and U.S. patent application Ser. No. 11/743,754 (now U.S. Patent Publication No. 2007/0263393), filed May 3, 2007, the entireties of which are hereby incorporated by reference;

U.S. Patent Application No. 60/809,618, filed on May 31, 2006, entitled "LIGHTING DEVICE AND METHOD OF LIGHTING" (inventors: Gerald H. Negley, Antony Paul van de Ven and Thomas G. Coleman) and U.S. patent application Ser. No. 11/755,153 (now U.S. Patent Publication No.

2007/0279903), filed May 30, 2007, the entireties of which are hereby incorporated by reference;

U.S. Patent Application No. 60/845,429, filed on Sep. 18, 2006, entitled "LIGHTING DEVICES, LIGHTING ASSEMBLIES, FIXTURES AND METHODS OF USING SAME" (inventor: Antony Paul van de Ven), and U.S. patent application Ser. No. 11/856,421 (now U.S. Patent Publication No. 2008/0084700), filed Sep. 17, 2007, the entireties of which are hereby incorporated by reference;

U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley), and U.S. patent application Ser. No. 11/859,048 (now U.S. Patent Publication No. 2008/0084701), filed Sep. 21, 2007, the entireties of which are hereby incorporated by reference;

U.S. Patent Application No. 60/858,558, filed on Nov. 13, 2006, entitled "LIGHTING DEVICE, ILLUMINATED ENCLOSURE AND LIGHTING METHODS" (inventor: Gerald H. Negley) and U.S. patent application Ser. No. 11/939,047 (now U.S. Patent Publication No. 2008/0112183), filed Nov. 13, 2007, the entireties of which are hereby incorporated by reference;

U.S. Patent Application No. 60/858,881, filed on Nov. 14, 2006, entitled "LIGHT ENGINE ASSEMBLIES" (inventors: Paul Kenneth Pickard and Gary David Trott) and U.S. patent application Ser. No. 11/939,052 (now U.S. Patent Publication No. 2008/0112168), filed Nov. 13, 2007, the entireties of which are hereby incorporated by reference;

U.S. Patent Application No. 60/859,013, filed on Nov. 14, 2006, entitled "LIGHTING ASSEMBLIES AND COMPONENTS FOR LIGHTING ASSEMBLIES" (inventors: Gary David Trott and Paul Kenneth Pickard) and U.S. patent application Ser. Nos. 11/736,799 11/939,059 (now U.S. Patent Publication No. 2008/0112170), filed Apr. 18, 2007, the entireties of which are hereby incorporated by reference;

U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard) and U.S. patent application Ser. No. 11/877,038 (now U.S. Patent Publication No. 2008/0106907), filed Oct. 23, 2007, the entireties of which are hereby incorporated by reference;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference;

U.S. Patent Application No. 60/916,384, filed on May 7, 2007, entitled "LIGHT FIXTURES, LIGHTING DEVICES, AND COMPONENTS FOR THE SAME" (inventors: Paul Kenneth Pickard, Gary David Trott and Ed Adams), and U.S. patent application Ser. No. 11/948,041 (now U.S. Patent Publication No. 2008/0137347), filed Nov. 30, 2007 (inventors: Gary David Trott, Paul Kenneth Pickard and Ed Adams), the entireties of which are hereby incorporated by reference;

U.S. Patent Application No. 60/916,030, filed on May 4, 2007, entitled "LIGHTING FIXTURE" (inventors: "Paul Kenneth Pickard, James Michael LAY and Gary David Trott) and U.S. patent application Ser. No. 12/114,994 (now U.S. Patent Publication No. 2008/0304269), filed May 5, 2008, the entireties of which are hereby incorporated by reference;

U.S. Patent Application No. 60/916,407, filed on May 7, 2007, entitled "LIGHT FIXTURES AND LIGHTING DEVICES" (inventors: Gary David Trott and Paul Kenneth Pickard), and U.S. patent application Ser. No. 12/116,341 (now U.S. Patent Publication No. 2008/0278952), filed May 7, 2008, the entireties of which are hereby incorporated by reference;

U.S. Patent Application No. 61/029,068, filed on Feb. 15, 2008, entitled "LIGHT FIXTURES AND LIGHTING DEVICES" (inventors: Paul Kenneth Pickard and Gary David Trott), U.S. Patent Application No. 61/037,366, filed on Mar. 18, 2008, and U.S. patent application Ser. No. 12/116,346 (now U.S. Patent Publication No. 2008/0278950), filed May 7, 2008, the entireties of which are hereby incorporated by reference; and U.S. patent application Ser. No. 12/116,348 (now U.S. Patent Publication No. 2008/0278957), filed on May 7, 2008, entitled "LIGHT FIXTURES AND LIGHTING DEVICES" (inventors: Paul Kenneth Pickard and Gary David Trott), the entirety of which is hereby incorporated by reference.

In some lighting devices according to the present inventive subject matter, there are further included one or more power sources, e.g., one or more batteries and/or solar cells, and/or one or more standard AC power plugs.

In a first representative embodiment according to the present inventive subject matter, there is provided a lighting device which is intended to emit white light (in particular, white light near the black body curve and having color temperature of 2700 K or 3500 K), and which includes three strings of LEDs, two of the strings comprising LEDs which emit BSY light, and the third string comprising LEDs which emit red light.

In this embodiment, the two strings of BSY LEDs are of intentionally different BSY hues, so that the relative intensities of those strings may be adjusted to move along the tie line between the respective color coordinates (on a CIE Diagram) for the two strings. By providing a red string, the intensity of the red string can be adjusted to tune the light output from the lighting device e.g., to the blackbody curve (or to within a desired minimum distance therefrom). Furthermore, variation in individual LEDs even within a string may be taken into account in the tuning process. Thus, by tuning after manufacture, the need for narrow bins of LEDs may be eliminated.

FIG. 1 is a drawing of the overall configuration of the power supply and the LED strings for the first representative embodiment. In this embodiment, as noted above, there are three strings. Two of the strings are the same type of LED but from slightly different bins to provide slightly different hues, such as two BSY strings. (See U.S. Patent Application No. 60/868,986, filed on Dec. 7, 2006, entitled "LIGHTING DEVICE AND LIGHTING METHOD" (inventors: Antony Paul van de Ven and Gerald H. Negley), and U.S. patent application Ser. No. 11/951,626 (now U.S. Patent Publication No. 2008/0136313), filed Dec. 6, 2007, the entireties of which are hereby incorporated by reference.) The third string is a substantially different hue, such as red LEDs. Differences in brightness and/or hue among the individual solid state light emitters within a string are of concern only if such differences prevent the overall light output from being tuned to the desired color temperature and/or lumen output.

Figure 2:
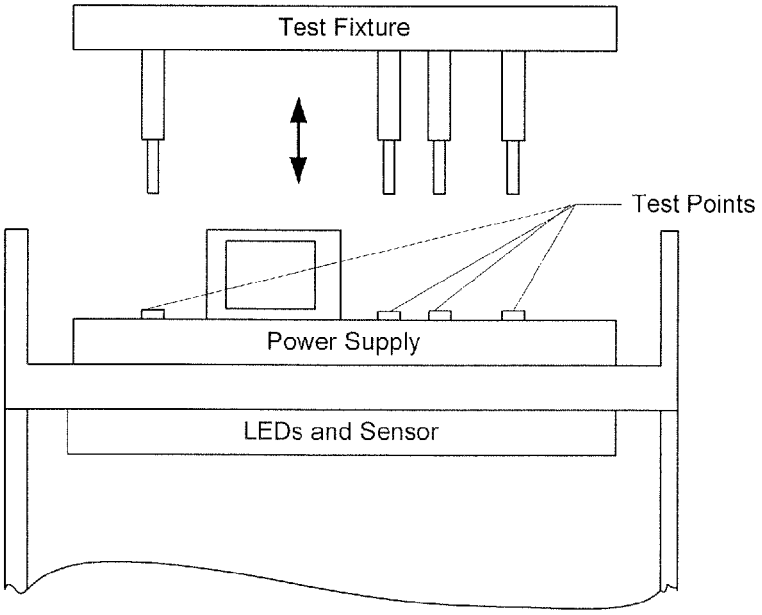
FIG. 2 is a drawing of a representative example of a test fixture that can be used according to the present inventive subject matter to provide access to test points on a power supply printed circuit board.

FIG. 2 is a drawing of a representative example of a test fixture that can be used according to the present inventive subject matter to provide access to test points on a power supply printed circuit board. Spring-loaded pins contact the test points and allow external manipulation of the lines connected to the test points. Thus, the relative currents of the LED strings can be manipulated by the testing/tuning system.

Figure 3:
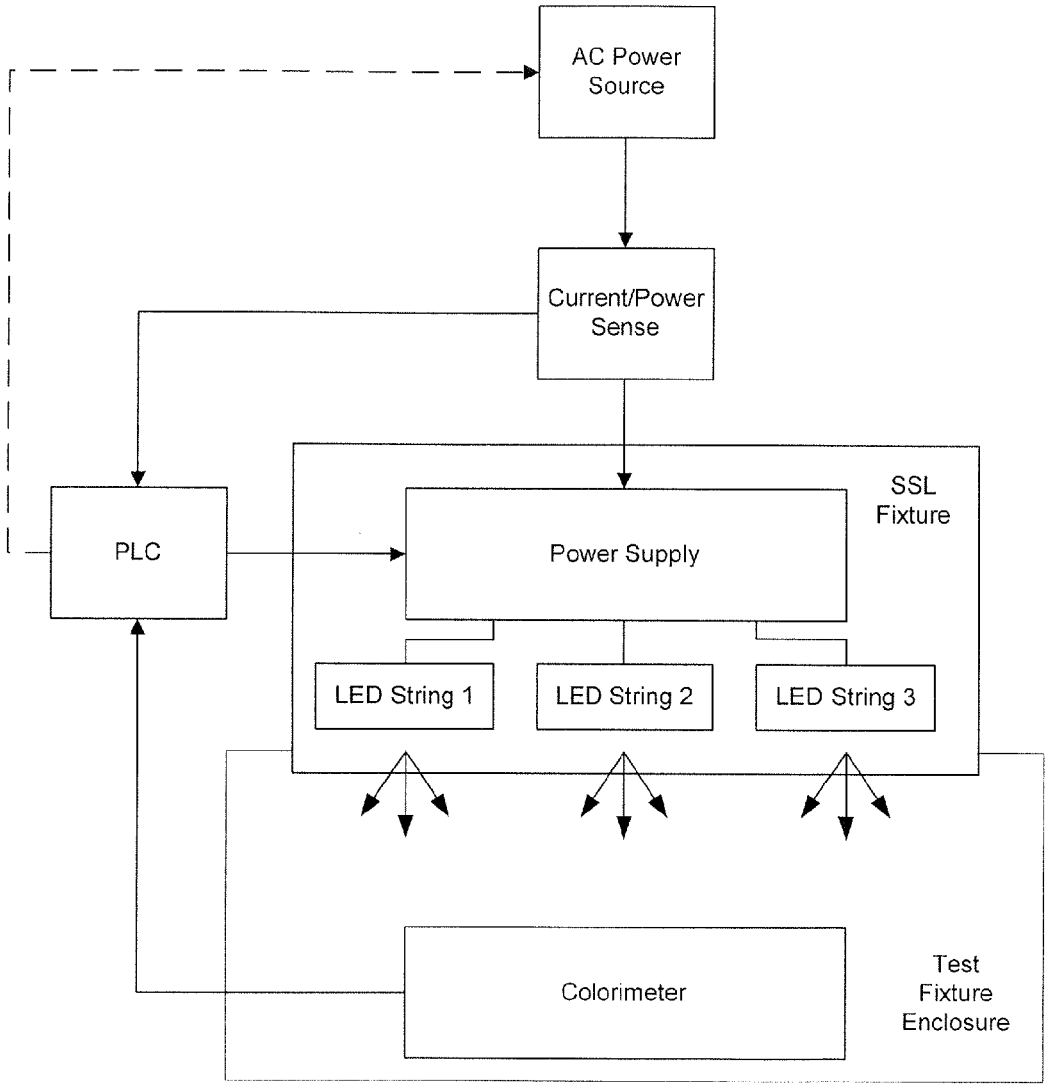
FIG. 3 is a block diagram of a representative example of a testing/tuning system that can be used according to the present inventive subject matter.

FIG. 3 is a block diagram of a representative example of a testing/tuning system that can be used according to the present inventive subject matter. A programmable logic controller (PLC) controls operations of the test system. The PLC is connected to a current/power sensing device and a colorimeter. The PLC may also control the AC power supply that provides power to the lighting device being tuned and tested. The current/power sensor may, for example, be a conventional power meter. The colorimeter may be any suitable colorimeter capable of measuring the color temperature of the light output from the device. Preferably the colorimeter is contained within a chamber that prevents external light from affecting the measurement. Furthermore, the chamber itself should be configured so that the light output from the lighting device is not attenuated and is accurately measured by the colorimeter.

Figure 4:
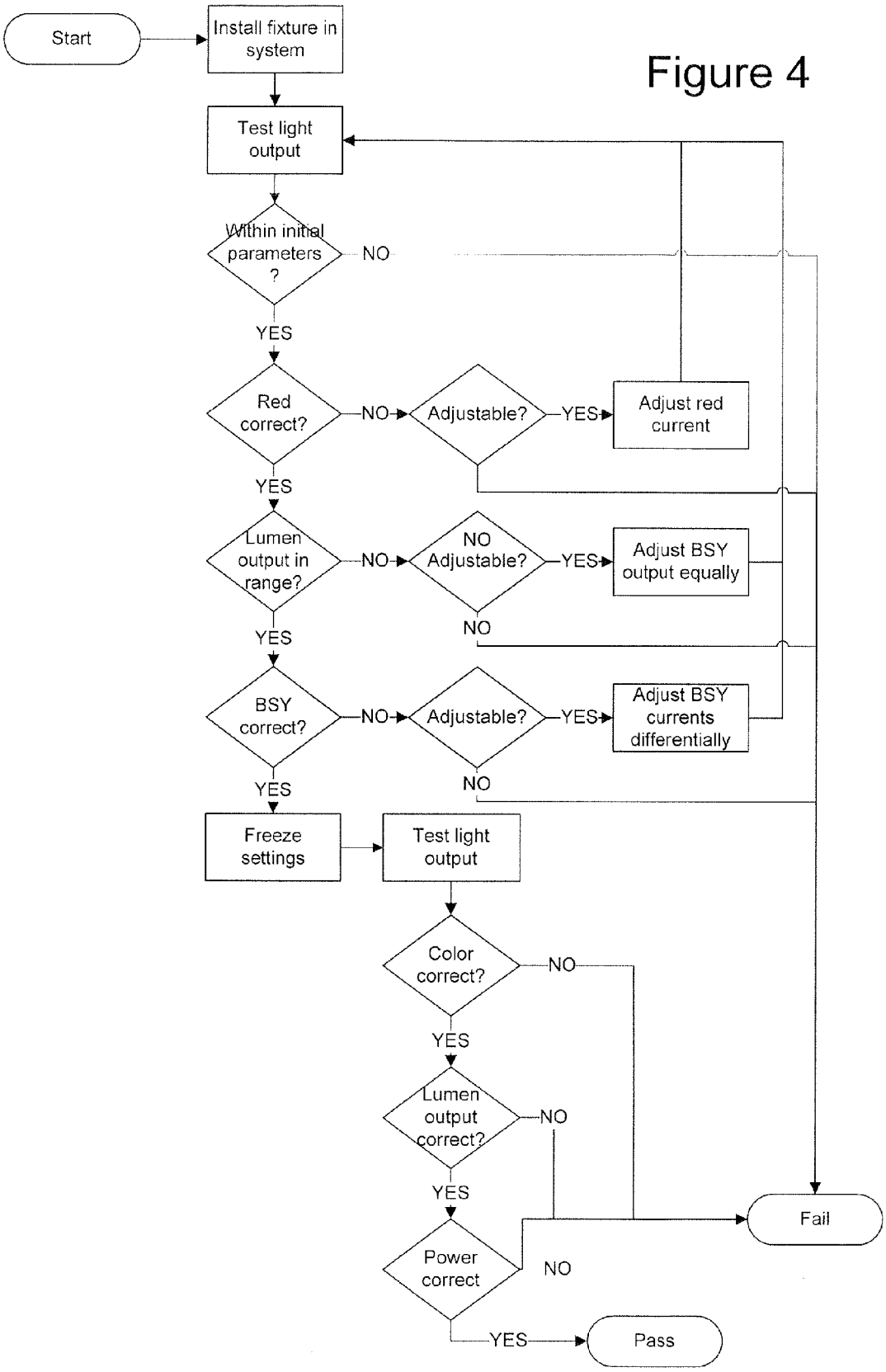
FIGS. 4 and 5 are illustrations for use in describing a representative example of an embodiment of a method according to the present inventive subject matter for operating the system of FIG. 3.
Figure 5:
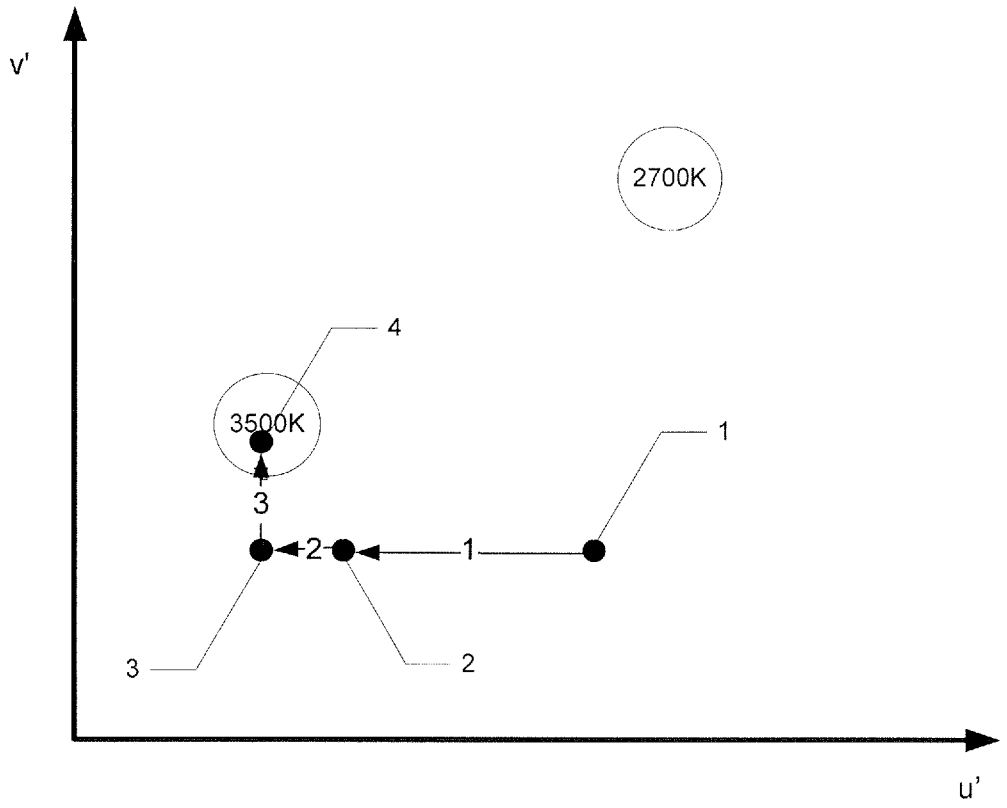

A representative example of an embodiment of a method according to the present inventive subject matter for operating the system of FIG. 3 is illustrated in FIGS. 4 and 5. In operation, the lighting device is placed in the test fixture and the power supply is contacted by a system such as that illustrated in FIG. 2. AC power is supplied to the lighting device and light output is directed to the colorimeter. The lighting device may be allowed to warm up before the light output is measured in order to avoid false color readings, i.e., the intensity of light emitted by solid state light emitters can vary as a result of temperature variance (even though the energy being supplied is not changed), and such variance differs from one type of solid state light emitter to another (e.g., from solid state light emitters that emit light of one color vs. solid state light emitters that emit light of some other color). The colorimeter measures the light output of the complete lighting device and provides this information to the PLC. The power is also sensed and provided to the PLC. An initial evaluation of the operation of the lighting device is analyzed to assure that the color point, the lumen output and the power are within ranges which will allow the lighting device to be tuned to the desired color temperature, lumen output and power. If not, the lighting device is rejected.

In this embodiment, if the initial values are within range, the PLC evaluates the u',v' color coordinates of the light output and determines if the red string (String 3 in FIG. 1) needs to be and can be adjusted. The determination of whether the red string needs to be adjusted is based on the current light output and whether that light output is sufficiently close to the desired color temperature to be within the specifications for the lighting device. In particular, if the u' coordinate is within the desired range for the lighting device, then no adjustment is needed. If the u' coordinate is outside the desired range, then the red current is either increased or decreased to move the u' coordinate of the light closer to the target range. If there is an insufficient ability to change the current of the red strings to move the u' coordinate enough to hit the target range, then the lighting device cannot be tuned and the part is rejected (or it might be suitable for use in making a lighting device of a different color temperature). Similarly, to avoid endless loops, if the u' coordinate is not moved to within the target range within a predefined number of adjustments, the part may be rejected.

In this embodiment, if the current of the red strings is able to be adjusted to move the u' coordinate to within the target range, the lumen output of the lighting device is then measured. If the lumen output is not within the desired range, the currents through the respective strings of different color emitting solid state light emitters are proportionately changed to achieve the desired lumen output. In some embodiments according to the present inventive subject matter, the current supplied to the red light-emitting solid state light emitters is automatically adjusted based on the intensity of light output by the strings containing BSY solid state light emitters—in such embodiments, such proportional changing of current supplied involves only changing the current supplied to the strings containing BSY solid state light emitters because the current supplied to the string of red solid state light emitters is "locked" to the intensity of the BSY output through the sensor. Thus, the currents through both of the BSY strings and the current through the red string are either increased or decreased if the lumen output is low or high, respectively. If the desired minimum lumen output cannot be achieved, the part is rejected.

In this embodiment, next, the v' coordinate is evaluated and the currents supplied to the strings of BSY solid state light emitters are adjusted to move the v' coordinate into the desired range. If the v' coordinate is outside the desired range, then the current supplied to one string of BSY solid state light emitters is increased and/or the current supplied to the other string of BSY solid state light emitters is decreased, to move the v' coordinate of the light closer to the target range. In some embodiments, if the current supplied to one string of BSY solid state light emitters is increased, the current supplied to the other string of BSY solid state light emitters is decreased, so that the overall intensity of the two BSY strings is kept fairly constant, so that the control loop of the reds does not substantially change the red output. (See the sensors disclosed in U.S. Patent Application No. 60/943,910, filed on Jun. 14, 2007, entitled "DEVICES AND METHODS FOR POWER CONVERSION FOR LIGHTING DEVICES WHICH INCLUDE SOLID STATE LIGHT EMITTERS" (inventor: Peter Jay Myers)). In particular embodiments, the current to the BSY strings is initially about equal. If the v' coordinate is not within the target range, then the current to the first BSY string is set to its maximum value in the adjustment range and the current to the second BSY string is set to its minimum value in the adjustment range. If the v' coordinate is still not in the target range, then the current through the first BSY string is set to its minimum value and the current through the second BSY string is set to its maximum. In some embodiments, the range of adjustment for the BSY strings may be +/−50%, in other embodiments+/−32% and in still other embodiments+/−20%. In some embodiments, the range of adjustment of the BSY strings provides for less deviation in the v' direction than the size of the acceptable target range (in such embodiments, even the maximum v' adjustment will not cause the color point to "overshoot" the acceptable target range; in addition, in such embodiments, the potential deviation in the u' direction that can be obtained by adjusting the respective currents supplied to the respective strings can be larger, e.g., much larger). Those of skill in the art will appreciate that greater differences in currents between the BSY strings may reduce power supply efficiency. Thus, it may be beneficial to control the bins for the BSY strings such that about equal current through the BSY strings will result in a v' value within the target range. If there is an insufficient ability to change the current of the BSY strings to move the v' coordinate enough to hit the target range, then the lighting device cannot be tuned and the part is rejected. Again, to avoid endless loops, if the v' coordinate is not moved to within the target range within a predefined number of adjustments, the part may be rejected.

In this embodiment, once the v' coordinate of the light from the lighting device is within the desired range, (and thus the coordinated color temperature of the light from the lighting device is within the desired range) the lumen output of the lighting device is again measured. If the lumen output is not within the desired range, the currents through the solid state light emitters are proportionately changed to achieve the desired lumen output. In embodiments in which the red current is locked to the intensity of the BSY output through the sensor (i.e., in which the red current is automatically varied as a result of any variance in the BSY output), this involves only changing the BSY output. If the lumen output cannot be achieved, the part is rejected.

In this embodiment, once the color and lumen output are tuned, the current values for the BSY strings are permanently set, and the current supplied to the red string at the initial BSY lumen output is set. This can be achieved by blowing fuses, zener zapping or other known techniques for setting the solid state light emitter currents, for example, by fixing reference values within the power supply which establish the amount of current through the respective strings of solid state light emitters. Thus, the currents are tunable based upon characteristics of the specific device (and components thereof) being used.

In this embodiment, after the lighting device settings are permanently established, the output of the lighting device and the power consumed by the lighting device are again measured. This may be after cycling power to the lighting device. The light output is compared to the desired targets for color and lumen output and the part is rejected if the light output does not meet both desired specifications. The power input to the lighting device is also measured to see if it is below the maximum desired power and has an acceptable power factor. If not, the part is rejected.

In the example in FIG. 5, the target color temperature is 3500 K. The initial light output is evaluated and the PLC is informed that the light output is at point 1 of FIG. 5. The PLC determines that an adjustment to move the light along line segment 1 is needed and it controls the power supply to adjust the current supplied to the red string. The amount of adjustment may be selected based on the distance in the u' direction that point 1 is from the target range. After the current is adjusted, the light is measured again and determined to be at point 2. The PLC again determines how much red adjustment is needed to move the color point into the target u' range and adjusts the red current accordingly. The light output is again measured and the color point is determined to be at point 3. Point 3 is within the u' range and so the PLC begins adjustment of the BSY intensity.

The PLC adjusts the BSY intensity by increasing or decreasing the current through one or both of the two BSY strings to move the color point in the v' direction. The amount and direction of change is based on the location of point 3 in relation to the target v' range. In some embodiments of the present inventive subject matter, the currents are adjusted in opposite directions to maintain BSY intensity while changing color. As noted above, in some embodiments of the present inventive subject matter, if the BSY intensity were not maintained, the red intensity would be automatically adjusted, which would move the color point in the u' direction as well as the v' direction. The light output is then again measured and determined to be point 4. Point 4 is within the target range for a 3500 K lighting device and so the current settings for the BSY strings and the red strings are permanently established for the lighting device.

After the settings are permanently established, the lighting device is tested to see if the settings were properly set by cycling AC power to the lighting device and then remeasuring the light output.

By tuning the output of the lighting device after assembly, in accordance with the present inventive subject matter, variations in manufacturing can be reduced and even minimized. Furthermore, the output from the lighting device may be directly measured, as opposed to being computed based on component outputs. Assuring that the lighting device output is accurate may be important in establishing compliance with standards, such as the U.S. Department of Energy's Energy Star standard.

In addition to the ability to tune what would otherwise be noticeably different color lighting devices to the same color point, by selection of the BSY bins correctly, the same components may be tuned to make 2700 K or 3500 K lighting devices (or lighting devices of any desired color temperature). This flexibility can greatly improve the ability to meet differing demand for the lighting devices and can reduce manufacturing complexity and parts inventory requirements.

Another important benefit provided by the present inventive subject matter is that the tuning process nulls out errors or offsets in the current sensing circuits. This allows the use of less accurate current sensing circuits, current mirrors, etc. The relative accuracy over temperature or operating conditions is still important, but the initial offsets or errors are not.

With regard to any mixed light described herein in terms of its proximity (e.g., in MacAdam ellipses) to the blackbody locus on a 1931 CIE Chromaticity Diagram and/or on a 1976 CIE Chromaticity Diagram, the present inventive subject matter is further directed to such mixed light in the proximity of light on the blackbody locus having color temperature of 2700 K, 3000 K or 3500 K, namely:

mixed light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4578, 0.4101, the second point having x, y coordinates of 0.4813, 0.4319, the third point having x, y coordinates of 0.4562, 0.4260, the fourth point having x, y coordinates of 0.4373, 0.3893, and the fifth point having x, y coordinates of 0.4593, 0.3944 (i.e., proximate to 2700 K); or mixed light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4338, 0.4030, the second point having x, y coordinates of 0.4562, 0.4260, the third point having x, y coordinates of 0.4299, 0.4165, the fourth point having x, y coordinates of 0.4147, 0.3814, and the fifth point having x, y coordinates of 0.4373, 0.3893 (i.e., proximate to 3000 K); or mixed light having x, y color coordinates which define a point which is within an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.4073, 0.3930, the second point having x, y coordinates of 0.4299, 0.4165, the third point having x, y coordinates of 0.3996, 0.4015, the fourth point having x, y coordinates of 0.3889, 0.3690, and the fifth point having x, y coordinates of 0.4147, 0.3814 (i.e., proximate to 3500 K).

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A method of making a lighting device, said method comprising:

measuring a first color output of a lighting device while supplying a first string initial current to a first string of solid state lighting devices, a second string initial current to a second string of solid state lighting devices and a third string initial current to a third string of solid state lighting devices, said lighting device comprising at least said first string of solid state lighting devices, said second string of solid state lighting devices, said third string of solid state lighting devices and a power line, adjusting the current supplied to at least one of said first string of solid state lighting devices, said second string of solid state lighting devices and said third string of solid state lighting devices such that a first string final current is supplied to said first string of solid state lighting devices, a second string final current is supplied to said second string of solid state lighting devices and a third string final current is supplied to said third string of solid state lighting devices;

permanently setting said first string of solid state lighting devices, such that if any line voltage is supplied to said power line, said first string final current will be supplied to said first string of solid state lighting devices;

permanently setting said second string of solid state lighting devices, such that if any line voltage is supplied to said power line, said second string final current will be supplied to said second string of solid state lighting devices.

2. The method as recited in claim 1, wherein:

said first string of solid state lighting devices comprises at least one solid state lighting device which, if power is supplied to said first string, emits light having x, y color coordinates which define a point which is within an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to a fifth point, and said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38, said second string of solid state lighting devices comprises at least one solid state lighting device which, if power is supplied to said second string, emits light having x, y color coordinates which define a point which is within an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to a fifth point, and said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38, said third string of solid state lighting devices comprises at least one solid state lighting device which, if power is supplied to said third string, emits light having a dominant wavelength in the range of from about 600 nm to about 640 nm.

3. The method as recited in claim 1, wherein after said adjusting the current supplied to at least one of said first string of solid state lighting devices, said second string of solid state lighting devices and said third string of solid state lighting devices, a color of a mixture of light emitted by said lighting device corresponds to a point on a 1976 CIE Chromaticity Diagram having u', v' coordinates in which said u' coordinate is within a predetermined u' coordinate range and said v' coordinate is within a predetermined v' coordinate range.

4. The method as recited in claim 1, wherein said method further comprises supplying current to said first string of solid state lighting devices, said second string of solid state lighting devices and said third string of solid state lighting devices for at least a period of time which is sufficient that any additional changes in temperature caused by continued operation of the lighting device does not result in a difference in color output that would be perceivable by a person with average eyesight.

5. The method as recited in claim 1, wherein said adjusting the current supplied to at least one of said first string of solid state lighting devices, said second string of solid state lighting devices and said third string of solid state lighting devices comprises:

adjusting the current supplied to said third string of solid state lighting devices to a third string adjusted current;

then measuring a second color output of said lighting device while supplying said first string initial current to said first string of solid state lighting devices, said second string initial current to said second string of solid state lighting devices and said third string adjusted current to said third string of solid state lighting devices, then increasing the current supplied to said first string of solid state lighting devices to a first string adjusted current and decreasing the current supplied to said second string of solid state lighting devices to a second string adjusted current.

6. The method as recited in claim 5, wherein:

after said adjusting the current supplied to said third string of solid state lighting devices to a third string adjusted current, a color of a mixture of light emitted by said lighting device corresponds to a point on a 1976 CIE Chromaticity Diagram having u', v' coordinates in which said u' coordinate is within a predetermined u' coordinate range, and after said increasing the current supplied to said first string of solid state lighting devices to a first string adjusted current and decreasing the current supplied to said second string of solid state lighting devices to a second string adjusted current, a color of a mixture of light emitted by said lighting device corresponds to a point on a 1976 CIE Chromaticity Diagram having u', v' coordinates in which said v' coordinate is within a predetermined v' coordinate range.

7. The method as recited in claim 5, wherein said method further comprises:

measuring lumen output by said lighting device after said adjusting the current supplied to said third string of solid state lighting devices to a third string adjusted current; and proportionately adjusting the current supplied to said first string of solid state lighting devices, the current supplied to said second string of solid state lighting devices and the current supplied to said third string of solid state lighting devices after said adjusting the current supplied to said third string of solid state lighting devices to a third string adjusted current.

8. The method as recited in claim 5, wherein said method further comprises:

measuring lumen output by said lighting device after said increasing the current supplied to said first string of solid state lighting devices to a first string adjusted current and decreasing the current supplied to said second string of solid state lighting devices to a second string adjusted current; and proportionately adjusting the current supplied to said first string of solid state lighting devices, the current supplied to said second string of solid state lighting devices and the current supplied to said third string of solid state lighting devices after said increasing the current supplied to said first string of solid state lighting devices to a first string adjusted current and decreasing the current supplied to said second string of solid state lighting devices to a second string adjusted current.

9. The method as recited in claim 1, wherein said adjusting the current supplied to at least one of said first string of solid state lighting devices, said second string of solid state lighting devices and said third string of solid state lighting devices comprises:

adjusting the current supplied to said third string of solid state lighting devices to a third string adjusted current;

then measuring a second color output of said lighting device while supplying said first string initial current to said first string of solid state lighting devices, said second string initial current to said second string of solid state lighting devices and said third string adjusted current to said third string of solid state lighting devices, then adjusting the current supplied to said first string of solid state lighting devices to a first string adjusted current and/or adjusting the current supplied to said second string of solid state lighting devices to a second string adjusted current.

10. The method as recited in claim 9, wherein:

after said adjusting the current supplied to said third string of solid state lighting devices to a third string adjusted current, a color of a mixture of light emitted by said lighting device corresponds to a point on a 1976 CIE Chromaticity Diagram having u', v' coordinates in which said u' coordinate is within a predetermined u' coordinate range, and after said adjusting the current supplied to said first string of solid state lighting devices to a first string adjusted current and/or adjusting the current supplied to said second string of solid state lighting devices to a second string adjusted current, a color of a mixture of light emitted by said lighting device corresponds to a point on a 1976 CIE Chromaticity Diagram having u', v' coordinates in which said v' coordinate is within a predetermined v' coordinate range.

11. The method as recited in claim 9, wherein said method further comprises:

measuring lumen output by said lighting device after said adjusting the current supplied to said third string of solid state lighting devices to a third string adjusted current; and proportionately adjusting the current supplied to said first string of solid state lighting devices, the current supplied to said second string of solid state lighting devices and the current supplied to said third string of solid state lighting devices after said adjusting the current supplied to said third string of solid state lighting devices to a third string adjusted current.

12. The method as recited in claim 9, wherein said method further comprises:

measuring lumen output by said lighting device after said adjusting the current supplied to said first string of solid state lighting devices to a first string adjusted current and/or adjusting the current supplied to said second string of solid state lighting devices to a second string adjusted current; and proportionately adjusting the current supplied to said first string of solid state lighting devices, the current supplied to said second string of solid state lighting devices and the current supplied to said third string of solid state lighting devices after said adjusting the current supplied to said first string of solid state lighting devices to a first string adjusted current and/or adjusting the current supplied to said second string of solid state lighting devices to a second string adjusted current.

13. The method as recited in claim 1, wherein after permanently setting said first string of solid state lighting devices and said second string of solid state lighting devices, if current is supplied to a power line of said lighting device, a color of light exiting said lighting device will have x, y coordinates on a 1931 CIE Chromaticity Diagram which define a point which is within 10 MacAdam ellipses of at least one point on the blackbody locus on a 1931 CIE Chromaticity Diagram.

14. The method as recited in claim 1, wherein said method further comprises setting the third string final current relative to the intensity of a mixture of light emitted by at least the first string of solid state lighting devices and the second string of solid state lighting devices.

15. The method as recited in claim 1, wherein said method further comprises setting the third string final current relative to the intensity of a mixture of light emitted by all solid state lighting devices in the lighting device which emit BSY light.

16. A method of making a lighting device, said method comprising:

measuring a first color output of a lighting device while supplying a first string initial current to a first string of solid state lighting devices and a second string initial current to a second string of solid state lighting devices, said lighting device comprising at least said first string of solid state lighting devices and said second string of solid state lighting devices, adjusting the current supplied to at least one of said first string of solid state lighting devices and said second string of solid state lighting devices such that a first string final current is supplied to said first string of solid state lighting devices and a second string final current is supplied to said second string of solid state lighting devices; and permanently setting said first string of solid state lighting devices, such that if any line voltage is supplied to the first string of solid state lighting devices, said first string final current will be supplied to the first string of solid state lighting devices.

17. The method as recited in claim 16, wherein:

said first string of solid state lighting devices comprises at least one solid state lighting device which, if power is supplied to said first string, emits light having x, y color coordinates which define a point which is within an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to a fifth point, and said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38, and said second string of solid state lighting devices comprises at least one solid state lighting device which, if power is supplied to said third string, emits light having a dominant wavelength in the range of from about 600 nm to about 640 nm.

18. The method as recited in claim 16, wherein after said adjusting the current supplied to at least one of said first string of solid state lighting devices and said second string of solid state lighting devices and said third string of solid state lighting devices, a color of a mixture of light emitted by said lighting device corresponds to a point on a 1976 CIE Chromaticity Diagram having u', v' coordinates in which said u' coordinate is within a predetermined u' coordinate range and said v' coordinate is within a predetermined v' coordinate range.

19. A method of tuning a lighting device to provide a desired color output having u'v' coordinates within a target range on a 1976 CIE Chromaticity Diagram, the lighting device comprising a first string and a second string of solid state lighting devices, both of said first and second strings comprising at least one solid state lighting device which emits light having x, y color coordinates which define a point which is within an area on a 1931 CIE Chromaticity Diagram, and a third string of solid state lighting devices comprising at least one solid state lighting device, the method comprising:

(1) measuring a color output of the lighting device while supplying a first string initial current to said first string of solid state lighting devices, a second string initial current to said second string of solid state lighting devices and a third string initial current to said third string of solid state lighting devices;

(2) comparing the color output to said target range;

(3) adjusting the current supplied to at least one of the first string of solid state light emitters, the second string of solid state light emitters and the third string of solid state light emitters to bring the color output within said target range, such that a first string final current is supplied to the first string of solid state light emitters, a second string final current is supplied to the second string of solid state light emitters and a third string final current is supplied to the third string of solid state light emitters; and (4) permanently setting a current supplied to the first string of solid state lighting devices, such that if any line voltage is supplied to the first string of solid state lighting devices, said first string final current will be supplied to the first string of solid state lighting devices, and permanently setting a current supplied to the second string of solid state lighting devices, such that if any line voltage is supplied to the second string of solid state lighting devices, said second string final current will be supplied to the second string of solid state lighting devices.

20. The method as recited in claim 19, wherein:

said first string of solid state lighting devices comprises at least one solid state lighting device which, if power is supplied to said first string, emits light having x, y color coordinates which define a point which is within an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to a fifth point, and said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38, said second string of solid state lighting devices comprises at least one solid state lighting device which, if power is supplied to said second string, emits light having x, y color coordinates which define a point which is within an area on a 1931 CIE Chromaticity Diagram enclosed by first, second, third, fourth and fifth line segments, said first line segment connecting a first point to a second point, said second line segment connecting said second point to a third point, said third line segment connecting said third point to a fourth point, said fourth line segment connecting said fourth point to a fifth point, and said fifth line segment connecting said fifth point to said first point, said first point having x, y coordinates of 0.32, 0.40, said second point having x, y coordinates of 0.36, 0.48, said third point having x, y coordinates of 0.43, 0.45, said fourth point having x, y coordinates of 0.42, 0.42, and said fifth point having x, y coordinates of 0.36, 0.38, and said third string of solid state lighting devices comprises at least one solid state lighting device which, if power is supplied to said third string, emits light having a dominant wavelength in the range of from about 600 nm to about 640 nm.

* * * * *